US008697327B2

(12) United States Patent
Shibata et al.

(10) Patent No.: US 8,697,327 B2
(45) Date of Patent: Apr. 15, 2014

(54) TONER PRODUCTION PROCESS AND TONER

(75) Inventors: Takaho Shibata, Tokyo (JP); Masayoshi Kato, Tokyo (JP); Ryuji Higashi, Kawasaki (JP); Takayuki Toyoda, Yokohama (JP); Ryo Natori, Tokyo (JP); Yuya Chimoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/264,136

(22) PCT Filed: May 19, 2010

(86) PCT No.: PCT/JP2010/058849

§ 371 (c)(1),
(2), (4) Date: Oct. 12, 2011

(87) PCT Pub. No.: WO2010/137599

PCT Pub. Date: Dec. 2, 2010

(65) Prior Publication Data

US 2012/0040285 A1 Feb. 16, 2012

(30) Foreign Application Priority Data

May 28, 2009 (JP) ..... 2009-128493

(51) Int. Cl.

*G03G 9/093* (2006.01)
*G03G 9/08* (2006.01)
*G03G 9/087* (2006.01)

(52) U.S. Cl.

CPC ..... *G03G 9/0804* (2013.01); *G03G 9/08759* (2013.01); *G03G 9/08791* (2013.01); *G03G 9/093* (2013.01)

USPC ..... 430/137.14; 430/110.1; 430/110.2; 430/137.11

(58) Field of Classification Search

CPC ..... G03G 9/804; G03G 9/08759; G03G 9/08791; G03G 9/093

USPC ..... 430/110.1, 110.2, 137.11, 137.14

See application file for complete search history.

(56) References Cited

U.S. PATENT DOCUMENTS

| | | | | |
|---|---|---|---|---|
| 4,802,977 | A | 2/1989 | Kanda et al. | |
| 4,844,349 | A | 7/1989 | Kanda et al. | |
| 5,016,823 | A | 5/1991 | Kato et al. | |
| 5,111,998 | A | 5/1992 | Kanda et al. | |
| 5,270,143 | A | 12/1993 | Tomiyama et al. | |
| 5,319,424 | A | 6/1994 | Tomiyama et al. | |
| 5,338,638 | A | 8/1994 | Tsuchiya et al. | |
| 5,364,720 | A | 11/1994 | Nakazawa et al. | |
| 5,424,810 | A | 6/1995 | Tomiyama et al. | |
| 5,447,815 | A | 9/1995 | Kato et al. | |
| 5,489,498 | A | 2/1996 | Ohno et al. | |
| 5,712,075 | A | 1/1998 | Mitsumura et al. | |
| 5,753,396 | A | 5/1998 | Nakamura et al. | |
| 5,854,365 | A | 12/1998 | Ohno et al. | |
| 5,888,687 | A | 3/1999 | Matsumura et al. | |
| 5,931,306 | A | 8/1999 | Mitsumura et al. | |
| 6,207,339 | B1 | 3/2001 | Kato et al. | |
| 6,617,091 | B2 | 9/2003 | Nishimori et al. | |
| 7,141,342 | B2 | 11/2006 | Toyoda et al. | |
| 7,264,910 | B2 | 9/2007 | Toyoda et al. | |
| 7,288,357 | B2 | 10/2007 | Toyoda et al. | |
| 7,833,685 | B2 | 11/2010 | Tanaka et al. | |
| 7,833,687 | B2 | 11/2010 | Kato et al. | |
| 2007/0077510 | A1 * | 4/2007 | Nosella et al. | 430/109.4 |
| 2008/0182190 | A1 | 7/2008 | Arakawa | |
| 2009/0011357 | A1 | 1/2009 | Kawase et al. | |
| 2009/0075193 | A1 | 3/2009 | Murai et al. | |

FOREIGN PATENT DOCUMENTS

| | | | | |
|---|---|---|---|---|
| CN | 101231480 | A | 7/2008 | |
| JP | 10-73955 | A | 3/1998 | |
| JP | 2002-116574 | A | 4/2002 | |
| JP | 2004-4506 | A | 1/2004 | |
| JP | 2007-93809 | A | 4/2007 | |
| JP | 2007-178782 | A | 7/2007 | |
| JP | 2008-233432 | * | 10/2008 | G03G 9/087 |
| JP | 2008-233432 | A | 10/2008 | |
| JP | 2009-109717 | A | 5/2009 | |
| JP | 2009-109734 | A | 5/2009 | |

OTHER PUBLICATIONS

Translation of JP 2008-233432 published Oct. 2008.*

Okamura, et al., "Colloid-Chemical Studies on the Coagulation of Polyvinyl Emulsions by Electrolytes", Polymer Chemistry, vol. 17, No. 186, 1960, pp. 601-606 (with partial translation).

Chinese Office Action dated Oct. 23, 2012 in Chinese Application No. 201080023194.7.

PCT International Search Report and Written Opinion of the International Searching Authority, International Application No. PCT/JP2010/058849, Mailing Date Jul. 27, 2010.

Tani, et al., U.S. Appl. No. 13/333,643, filed Dec. 21, 2011.

* cited by examiner

*Primary Examiner* — Peter Vajda

(74) *Attorney, Agent, or Firm* — Fitzpatrick, Cella, Harper and Scinto

(57) ABSTRACT

A process for producing a core-shell toner is provided in which the toner has core particles containing at least a binder resin (1), a colorant and a release agent and shell layers which contain at least a resin (2) and with which the core particles are covered; and the process including the steps of (A) mixing a binder resin-(1) dispersion, a colorant dispersion and a release agent dispersion, (B) adding to a mixed dispersion thus obtained an agglomerating agent to effect agglomeration, (C) adding to core agglomerated particles thus formed a mixture prepared by mixing the resin-(2) dispersion and a metal salt to make the resin (2) adhere to the surfaces of the core agglomerated particles, and (D) heating core-shell agglomerated particles thus formed to a temperature not lower than the glass transition temperatures of the binder resin (1) and resin (2) to effect fusion thereof.

9 Claims, No Drawings

TONER PRODUCTION PROCESS AND TONER

TECHNICAL FIELD

This invention relates to a process for producing a toner for rendering electrostatic latent images visible in an image forming process such as electrophotography, and a toner obtained by such a toner production process.

BACKGROUND ART

In recent years, from the viewpoint of concern about earth environment, there is an increasing need for energy saving, and, in forming images in the electrophotography, it is required to make electric power less consumed in the fixing step that takes the considerable part of service electric power for a copying machine. For the achievement of energy saving in the fixing step, it is necessary to make toners fixable at a lower temperature. As a means for making toners fixable at a lower temperature, a technique is commonly known in which binder resins used in the toners are made to have a lower glass transition temperature. However, binder resins having too low glass transition temperature tend to cause aggregation between toner particles (a blocking phenomenon) to make it difficult to concurrently achieve storage stability of the toners.

As a means for resolving such a problem, what is called a core-shell toner is proposed in which particles serving as cores (hereinafter termed "core particles") composed of a binder resin having a low glass transition temperature are formed and shell layers are provided as coat layers on the surfaces of the core particles.

In Japanese Patent Applications Laid-open No. 2002-116574 and No. H10-73955, a method is proposed in which core particles are previously prepared by an emulsion agglomeration process or the like and shell layers are afterwards formed thereon. In Japanese Patent Application Laid-open No. 2004-004506, a method is also proposed in which a binder resin making up core particles and an organic phase containing a colorant are dispersed in an aqueous medium in the form of droplets and thereafter a monomer making up shell layers is allowed to react at interfaces of the droplets to form shell layers thereon by interfacial polymerization.

The above emulsion agglomeration is advantageous to the controlling of internal structure of toner particles, to the controlling of content of a colorant or a release agent, to the controlling of toner particle shapes that is intentionally made and to the production of toners made to have small particle diameter, in view of the principle of granulation that agglomerates are formed on from fine particles of a dispersion of a binder resin, a colorant and a release agent each.

In the case when the core-shell toner is produced by such emulsion agglomeration, first a dispersion of a binder resin used for cores and a dispersion of a colorant are mixed and thereafter the mixture is made to agglomerate by heating, pH control and/or addition of an agglomerating agent until particles come to have the desired particle diameter, to form core agglomerated particles. Thereafter, a dispersion of a binder resin newly used for shell layers is supplementally added to form shell layers with which the core agglomerated particles are covered, to obtain core-shell agglomerated particles. Further, the core-shell agglomerated particles obtained are heated to a temperature not lower than the glass transition temperature of the binder resin to effect fusion to produce the toner.

In such a conventional method, it may come about that any fine particles of the binder resin added supplementally in order to form the shell layers do not successfully adhere to the core agglomerated particles to remain as floating particles standing unreacted or come to be liberated from the core agglomerated particles in the course of the fusion. This has been found as a result of our studies. If such unreacted particles remain, it is difficult for shells to adhere uniformly to core particles, making it difficult to achieve both the desired low-temperature fixing performance and blocking resistance. This phenomenon may become remarkable especially where, between binder resin particles making up the core particles and binder resin particles making up the shell layers, the binder resin particles making up the shell layers are larger in critical agglomeration concentration, i.e., where the binder resin particles making up the shell layers are higher in dispersion stability and hence can more not easily come to agglomerate. As a specific example thereof, a case may be given in which the binder resin particles making up the core particles have a carboxyl group as an acidic group and the binder resin particles making up the shell layers have a sulfonic acid group as an acidic group.

DISCLOSURE OF THE INVENTION

The present invention has been made at an aim to remedy such a problem as stated above. More specifically, it is an object of the present invention to provide a process for producing a core-shell toner which can achieve both low-temperature fixing performance and blocking resistance by a simple method, by keeping it from coming about that the binder resin particles making up the shell layers remain as floating particles standing unreacted.

As a result of extensive studies made on the above prior art and problem, the present inventors have come to accomplish the present invention described below.

The present invention is a process for producing a core-shell toner having core particles which contain at least a binder resin (1), a colorant and a release agent and shell layers which contain at least a resin (2) and with which the core particles are covered; the process comprising:

(A) a mixing step of mixing at least a binder resin-(1) dispersion in which the binder resin (1) stands dispersed, a colorant dispersion in which the colorant stands dispersed and a release agent dispersion in which the release agent stands dispersed, to obtain a mixed dispersion;

(B) an agglomeration step of adding an agglomerating agent to the mixed dispersion to make the binder resin (1), the colorant and the release agent agglomerate to form core agglomerated particles;

(C) a metal salt loading step of mixing at least a resin-(2) dispersion in which the resin (2) stands dispersed and a metal salt soluble in a dispersion medium of the resin (2) dispersion, to prepare a metal salt loaded resin dispersion;

(D) a shell adhering step of adding the metal salt loaded resin dispersion to a dispersion in which the core agglomerated particles stand dispersed, to make the resin (2) adhere to the surfaces of the core agglomerated particles to form core-shell agglomerated particles; and (E) a fusion step of heating the core-shell agglomerated particles to a temperature not lower than the glass transition temperature of the binder resin (1) and resin (2) to effect fusion thereof.

According to the present invention, it can be kept from coming about that the binder resin particles making up the shell layers remain as floating particles standing unreacted, and hence a process can be provided which is to produce a small particle diameter core-shell toner which can achieve both the low-temperature fixing performance and the blocking resistance.

Further features of the present invention will become apparent from the following description of exemplary embodiments.

BEST MODE FOR CARRYING OUT THE INVENTION

The present invention is concerned with a core-shell toner production process, which is a process for producing a core-shell toner having core particles which contain at least a binder resin (1), a colorant and a release agent and shell layers which contain at least a resin (2) and with which the core particles are covered, and is characterized by having at least:

(A) a mixing step of mixing at least a binder resin-(1) dispersion in which the binder resin (1) stands dispersed, a colorant dispersion in which the colorant stands dispersed and a release agent dispersion in which the release agent stands dispersed, to obtain a mixed dispersion;

(B) an agglomeration step of adding an agglomerating agent to the mixed dispersion to make the binder resin (1), the colorant and the release agent agglomerate to form core agglomerated particles;

(C) a metal salt loading step of mixing a resin-(2) dispersion in which at least the resin (2) stands dispersed and a metal salt soluble in a dispersion medium of the resin (2) dispersion, to prepare a metal salt loaded resin dispersion;

(D) a shell adhering step of adding the metal salt loaded resin dispersion to a dispersion in which the core agglomerated particles stand dispersed, to make the resin (2) adhere to the surfaces of the core agglomerated particles to form core-shell agglomerated particles; and (E) a fusion step of heating the core-shell agglomerated particles to a temperature not lower than the glass transition temperature of the binder resin (1) and resin (2) to effect fusion thereof.

The respective steps of the core-shell toner production process are described below in detail.

(A) Mixing Step:

Stated specifically, this is the step of mixing at least the binder resin-(1) dispersion, the colorant dispersion and the release agent dispersion each prepared by dispersing the corresponding component in an aqueous medium, to obtain a mixed dispersion for making up core particles. There are no particular limitations on the order of mixing of these, which may be mixed by adding these dispersions simultaneously or may be mixed by adding them one by one. From the viewpoint of uniformity of the mixed dispersion, it is preferable for them to be mixed under appropriate application of mechanical stirring or shearing thereto.

As the aqueous medium, e.g., water such as distilled water or ion-exchanged water is preferred. A hydrophilic solvent readily miscible with water, such as methanol or acetone, may also be added as long as it does not adversely affect the stability of dispersions. From the viewpoint of environmental burden, however, it is preferable that the water is 100% by mass in content.

As the binder resin (1) that makes up the core particles, there are no particular limitations thereon, and any known resins used for toners may be used, as exemplified by polyesters, vinyl polymers such as a styrene-acrylic copolymer, epoxy resins, polycarbonates and polyurethanes. In particular, polyesters or a styrene-acrylic copolymer is/are preferred, and polyesters are much preferable from the viewpoint of compatibility with the colorant and fixing performance and running performance of the toner. The polyesters have, where they have a rigid aromatic ring in the backbone chain, a flexibility as compared with the vinyl polymers such as a styrene-acrylic copolymer, and hence can provide an mechanical strength equivalent to that of the vinyl polymers even though having a lower molecular weight than the latter. Thus, the polyesters are preferred also as resins suited for low-temperature fixing performance.

In the present invention, the above binder resin (1) may be used alone, or may be used in combination of two or more types. Where the binder resin (1) contains any polyester, the polyester may be either of crystallizable one and non-crystallizable one. The non-crystallizable polyester is preferable from the viewpoint of fluidity, offset prevention and running performance of the toner. The crystallizable polyester has a sharp-melt property attributable to its crystallizability, and hence has an advantage in regard to low-temperature fixing performance, but has a disadvantage that it is inferior in powder fluidity and image strength. Accordingly, the non-crystallizable polyester is much preferable as a chief component of the binder resin (1). Whether or not it is crystallizable or non-crystallizable may be distinguished by differential scanning calorimetry (DSC) of the polyester to examine what glass transition temperature and melting point it has.

Raw-material monomers of the polyester may include, but are not particularly limited to, known aliphatic, alicyclic or aromatic polybasic carboxylic acids and alkyl esters thereof, polyhydric alcohols and ester compounds thereof, and hydroxycarboxylic acid compounds. Any of these may be polymerized by direct esterification reaction, ester exchange reaction or the like to obtain the polyester. A monomer capable of forming any of the crystallizable polyester and the non-crystallizable polyester may also be used, but, for the above reasons, the monomer may preferably be a monomer capable of forming the non-crystallizable polyester.

The polyhydric alcohols refer to compounds having two or more hydroxyl groups in one molecule, and may include, but are not particularly limited to, the following monomers. As diols, they may specifically include aliphatic diols such as 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; and diols having cyclic structure, such as cyclohexanediol, cyclohexanedimethanol, bisphenol A, bisphenol C, bisphenol E, bisphenol F, bisphenol P, bisphenol S, bisphenol Z, hydrogenated bisphenol, biphenol, naphthalenediol, 1,3-adamantanediol, 1,3-adamantanedimethanol, 1,3-adamantanediethanol, and hydroxyphenyl cyclohexane. It is also preferable for any of these bisphenols to have at least one alkylene oxide group. Such an alkylene oxide group may include, but is not particularly limited to, an ethylene oxide group, a propylene oxide group and a butylene oxide group. It may preferably be an ethylene oxide group or a propylene oxide group, and its number of moles of oxide added may preferably be 1 to 3. Within this range so far, the viscoelasticity and glass transition temperature of the polyester to be produced can appropriately be controlled for use in the toner.

As a trihydric or higher alcohol, it may include, e.g., glycol, pentaerythritol, hexamethylolmelamine, hexaethylolmelamine, tetramethylolbenzoguanamine and tetraethylolbenzoguanamine.

Of the above polyhydric alcohols, preferably usable are hexanediol, cyclohexanediol, octanediol, dodecanediol, and alkylene oxide addition products of bisphenol A, bisphenol C, bisphenol E, bisphenol S and bisphenol Z.

Where the crystallizable polyester is used, an aliphatic diol having 2 to 8 carbon atoms may be used. This is preferable from the viewpoint of accelerating the crystallization of the polyester. In particular, it is preferable to use an α,ω-alkanediol, in particular, 4-butanediol, 1,6-hexanediol, 1,8-octanediol or a mixture of any of these. Such an alcohol component may be used alone or may be used in combination of two or more types. The aliphatic diol having 2 to 8 carbon atoms may preferably be in a content in its all alcohol components, of from 80 mole % to 100 mole %, and much preferably from 90 mole % to 100 mole %, from the viewpoint of accelerating the crystallization of the polyester. In particular, it preferable that the 1,4-butanediol, 1,6-hexanediol, 1,8-octanediol or a mixture of any of these is in a content in its all alcohol components, of from 80 mole % to 100 mole %, and much preferably from 90 mole % to 100 mole %.

Where the non-crystallizable polyester is used, it is preferable that an alkylene oxide addition product of bisphenol A is contained as a polyhydric alcohol, such as an alkylene (having 2 or 3 carbon atoms) oxide (average number of moles of oxide added: 1 to 16) addition product of bisphenol A as exemplified by polyoxypropylene(2.2)-2,2-bis(4-hydroxyphenyl)propane or polyoxyethylene(2.0)-2,2-bis(4-hydroxyphenyl)propane.

The polybasic carboxylic acid that is a monomer making up the polyester is a compound containing two or more carboxyl groups in one molecule, and may include, but is not particularly limited to, the following monomers.

It may include, e.g., aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, n-dodecenylsuccinic acid, nonanedicarboxylic acid, decanedicarboxylic acid, undecanedicarboxylic acid and dodecanedicarboxylic acid; alicyclic dicarboxylic acids such as 1,1-cyclopentenedicarboxylic acid, 1,4-cyclohexanedicarboxylic acid, 1,3-cyclohexanedicarboxylic acid, and 1,3-adamantanedicarboxylic acid; aromatic dicarboxylic acids such as phthalic acid, isophthalic acid, terephthalic acid, p-phenylenediacetic acid, m-phenylenediacetic acid, p-phenylenedipropionic acid, m-phenylenedipropionic acid, naphthalene-1,4-dicarboxylic acid, naphthalene-1,5-dicarboxylic acid, naphthalene-2,6-dicarboxylic acid; and tribasic or higher polybasic carboxylic acids such as trimellitic acid, pyromellitic acid, naphthalenetricarboxylic acid, naphthalenetetracarboxylic acid, pyrenetricarboxylic acid, and pyrenetetracarboxylic acid. Any of the above carboxylic acids may have a functional group other than the carboxyl group, and carboxylic acid derivatives such as acid anhydrides or acid esters may also be used.

Of the above polybasic carboxylic acids, preferable usable are sebacic acid, nonanedicarboxylic acid, decanedicarboxylic acid, undecanedicarboxylic acid, dodecanedicarboxylic acid, p-phenylenediacetic acid, m-phenylenediacetic acid, p-phenylenedipropionic acid, m-phenylenedipropionic acid, 1,4-cyclohexanedicarboxylic acid, 1,3-cyclohexanedicarboxylic acid, naphthalene-1,4-dicarboxylic acid, naphthalene-1,5-dicarboxylic acid, naphthalene-2,6-dicarboxylic acid, trimellitic acid and pyromellitic acid.

The polyester may also be obtained by using a hydroxycarboxylic acid compound like that containing a carboxylic acid and a hydroxyl group in one molecule. Such a monomer may include, but is not particularly limited to, e.g., hydroxyoctanoic acid, hydroxynonanoic acid, hydroxydecanoic acid, hydroxyundecanoic acid, hydroxydodecanoic acid, hydroxytetradecanoic acid, hydroxytridecanoic acid, hydroxyhexadecanoic acid, hydroxypentadecanoic acid and hydroxystearic acid.

Where the vinyl polymer is used, a vinyl monomer making up this polymer may include, but is not particularly limited to, the following vinyl monomers.

The vinyl monomer refers to a compound having one vinyl group in one molecule, and may include, e.g., styrenes such as styrene and p-chlorostyrene; ethylene unsaturated monoolefins such as ethylene, propylene, butylene and isobutylene; vinyl esters such as vinyl acetate, vinyl propionate, vinyl benzoate, vinyl butyrate, vinyl formate, vinyl stearate and vinyl caproate; acrylic or methacrylic acid and esters thereof, such as methyl acrylate, ethyl acrylate, n-butyl acrylate, isobutyl acrylate, dodecyl acrylate, n-octyl acrylate, 2-chloroethyl acrylate, phenyl acrylate, methyl-α-chloroacrylate, methyl methacrylate, ethyl methacrylate and methacrylic acid; ethylenic monocarboxylic acid derivatives such as butyl acrylonitrile, methacrylonitrile and acrylamide; ethylenic dicarboxylic acids and esters thereof, such as dimethyl maleate, diethyl maleate and dibutyl maleate; vinyl ketones such as methyl vinyl ketone, hexyl vinyl ketone and methyl isopropenyl ketone; vinyl ethers such as methyl vinyl ether, isobutyl vinyl ether and ethyl vinyl ether; vinylidene halides such as vinylidene chloride and vinylidene chlorofluoride; and N-vinyl heterocyclic compounds such as N-vinylpyrrole, N-vinylcarbazole, N-vinylindole and N-vinylpyrrolidone.

The vinyl polymer is a homopolymer of any of these vinyl monomers or a copolymer of two or more vinyl monomers, and may be obtained by polymerizing the monomer(s) by a known process such as solution polymerization, bulk polymerization or suspension polymerization.

The binder resin (1) used in the present invention may be a resin containing an acidic polar group, which resin may preferably be used from the viewpoint of a good dispersion stability of resin particles and a colorant dispersibility in the toner. Such an acidic polar group may include a carboxyl group, a sulfonic acid group, a phosphonic acid group and a sulfinic acid group. In particular, a carboxyl group or a sulfonic acid group is preferable from the viewpoint of dispersion stability of resin particles. Also, in order that the resin particles can have a good dispersion stability and a toner with small particle diameter can be obtained in a sharp particle size distribution, the binder resin (1) may preferably have an acid value of from 5 to 50 mgKOH/g, and much preferably from 10 to 30 mgKOH/g.

The glass transition temperature (Tg) of the binder resin is taken as the value measured at a heating rate of 3° C./min, according to the method (DSC method) prescribed in ASTM D3418-82.

Softening temperature (Tm) of the binder resin is also measured with a flow tester (CFT-500D, manufacture by Shimadzu Corporation). Stated specifically, 1.5 g of a sample to be measured is weighed out, and its softening temperature is measured using a die of 1.0 mm in height and 1.0 mm in diameter and under conditions of a heating rate of 4.0° C./min, a preheating time of 300 seconds, a load of 5 kg and a measurement temperature range of from 60 to 200° C. The temperature at which the above sample has flowed out by ½ is taken as the softening temperature (Tm).

The binder resin (1) used in the present invention is what makes up the core particles, and hence may take account of low-temperature fixing performance from the viewpoint of functional separation thereof from the shell layers. It may preferably have a glass transition temperature (Tg) of from 30° C. or more to 60° C. or less, and much preferably from 40° C. or more to 55° C. or less, and may preferably have a softening temperature (Tm) of from 80° C. or more to 150° C. or less, and much preferably from 80° C. or more to 120° C. or less. If it has a glass transition temperature lower than 30°

C., the toner may cause a problem in itself to, e.g., tend to cause blocking. If on the other hand the binder resin has a glass transition temperature higher than 60° C., the toner may inevitably have higher fixing temperature correspondingly thereto, and hence may come into question in view of its low-temperature fixing performance. Meanwhile, if the binder resin has a softening temperature lower than 80° C., the toner tends to cause wind-around of paper on a fixing assembly during fixing, i.e., what is called offset, and may cause a problem on its reliability. If on the other hand the binder resin has a softening temperature higher than 150° C., the toner may come to have higher fixing temperature correspondingly thereto, and hence may come into question in view of its low-temperature fixing performance.

The binder resin-(1) dispersion (water based dispersion) may be prepared by any of known processes given below (such as phase inversion emulsification, forced emulsification, emulsification polymerization and self-emulsification), which is by no means limited to these methods.

For example, in the case of phase inversion emulsification, first the binder resin (1) is dissolved in an amphiphilic organic solvent alone or a mixed solvent thereof. The resin solution obtained is stirred by using any known stirrer, emulsifier, dispersion machine or the like, during which a basic substance is dropwise added thereto, and thereafter, with further stirring, the aqueous medium is dropwise added on thereto, so that phase reversal takes place between the oily phase and the aqueous phase at a certain point of time, where the oily phase comes into oily droplets, and thereafter a step is taken to remove the solvent under reduced pressure, thus a water based dispersion is obtained in which the binder resin (1) stands dispersed.

Here, the amphiphilic organic solvent is one having a solubility in water at 20° C., of 5 g/liter or more, and preferably 10 g/liter or more. One which is less than 5 g/liter in this solubility has a problem that it may provide coarse dispersed particles or make the resultant water based dispersion have a poor storage stability.

The above amphiphilic organic solvent may be exemplified by alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol; ketones such as methyl ethyl ketone, methyl isobutyl ketone, ethyl butyl ketone, cyclohexanone and isophorone; ethers such as tetrahydrofuran and dioxane; esters such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate and dimethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate and dipropylene glycol monobutyl ether; and further 3-methoxy-3-methylbutanol, 3-methoxybutanol, acetonitrile, dimethylformamide, dimethylacetamide, diacetone alcohol and ethyl acetoacetate. Any of these solvents may be used alone or in the form of a mixture of two or more types.

As the basic substance, it may be any of inorganic and organic basic compounds, and may include, e.g., inorganic bases such as ammonia, sodium hydroxide, potassium hydroxide, sodium carbonate, potassium carbonate, sodium hydrogencarbonate and potassium hydrogencarbonate; and organic bases such as methylamine, dimethylamine, trimethylamine, ethylamine, diethylamine, triethylamine, dimethylaminoethanol, diethylaminoethanol, sodium succinate and sodium stearate. In particular, from the viewpoint of being causative of no hydrolysis, amines such as dimethylamine, triethylamine and dimethylaminoethanol are preferred as being weakly basic.

The basic substance may be added in an amount appropriately so controlled that the pH may generally be neutral at the time of mixing for dispersion. The basic substance tends to make the resulting binder resin (1) particles smaller in particle diameter as it is added in a larger amount. Also, where a strong base is used as the basic substance, it must be added in an amount so limited as not to cause any hydrolysis. From such a viewpoint, the basic substance used may preferably be in an amount of from 0.20 to 2.50 in equivalent weight, much preferably from 0.35 to 2.00 in equivalent weight, and further preferably from 0.50 to 1.75 in equivalent weight, based on the acidic polar group of the binder resin (1).

Any of these basic substances may be used alone or may be used in combination of two or more types. The basic substance may also be used as it is, but, so as to be uniformly added, may be mixed with an aqueous medium in the form of a solution.

Where the binder resin (1) is the vinyl polymer, the vinyl monomer may be polymerized by using a known polymerization process such as emulsion polymerization, mini-emulsion polymerization or seed polymerization, thus the dispersion is prepared in which the binder resin (1) stands dispersed in the aqueous medium.

The binder resin (1) standing dispersed in the aqueous medium may have such particle diameter that, since toners commonly have particle diameter of about 3 μm to about 8 μm, its volume distribution base 50% particle diameter (d50) is 0.5 μm or less and further preferably its volume distribution base 90% particle diameter (d90) is 1 μm or less, in order to keep compositional uniformity of the toner to be produced through the core agglomeration step, the shell adhering step and the fusion step, which are detailed later. Dispersed-particle diameter of the binder resin (1) may be measured with a Doppler scattering particle size distribution measuring instrument (MICROTRACK UPA9340, manufactured by Nikkiso Co. Ltd.) or the like.

The known stirrer, emulsifier or dispersion machine used in dispersing the binder resin (1) may include, e.g., an ultrasonic homogenizer, a jet mill, a pressure homogenizer, a colloid mill, a ball mill and a sand mill, any of which may be used alone or in combination.

As the colorant, there are no particular limitations thereon, and it may appropriately be selected from any known dyes and pigments and according to purposes. Typical examples are shown below, but are not particularly limited to these. In using a dye, the dye may be an oil-soluble dye, a direct dye, an acid dye, a basic dye, a reactive dye, a food coloring matter water-soluble dye or a disperse dye, any of which may be used. In using a pigment, the pigment may be either of an organic pigment and an inorganic pigment. The pigment may be used alone, or may be used in the form of a mixture of two or more types of pigments, or the pigment and the dye may be used in combination. Where two or more types of pigments are used in combination, pigments of the same color group may be used in combination, or pigments of different color groups may be used in combination. Also, in using the pigment and the dye in combination, the dye may preferably be in a content of 100 parts by mass or less, based on 100 parts by mass of the pigment, from the viewpoint of fastness to light.

As cyan group pigments or dyes, usable are copper phthalocyanine compounds and derivatives thereof, anthraquinone compounds, basic dye lake compounds and so forth. Stated specifically, they may include, e.g., C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

As magenta group organic pigments or organic dyes, usable are condensation azo compounds, diketopyrrolopyrrole compounds, anthraquinone compounds, quinacridone compounds, basic-dye lake compounds, naphthol compounds, benzimidazolone compounds, thioindigo compounds and perylene compounds. Stated specifically, they may include, e.g., C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

As yellow group organic pigments or organic dyes, usable are compounds as typified by condensation azo compounds, isoindolinone compounds, anthraquinone compounds, azo metal complexes, methine compounds and allylamide compounds. Stated specifically, they may include, e.g., C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

As black colorants, usable are carbon black, magnetic materials, and colorants toned in black by using, in combination, two or more of the yellow, magenta and cyan colorants shown above. A pigment having been surface-treated by a known method may also be used as the colorant.

The colorant may be used by adding it in an amount of from 1 to 30 parts by mass based on 100 parts by mass of the binder resin.

The colorant dispersion may be prepared by any known process given below, which is by no means limited to these methods.

For example, it may be prepared by mixing the colorant, the aqueous medium and a dispersant by means of any known stirrer, emulsifier, dispersion machine or the like. As the dispersant used here, any known dispersant may be used, as exemplified by a surface active agent, a high-molecular dispersant or the like, or a dispersant synthesized newly for the present invention may also be used. Any dispersant can be removed in a toner washing step described later. From the viewpoint of washing efficiency, however, a surface active agent described below is preferred. Of the surface active agent, an anionic surface active agent, a nonionic surface active agent or the like is preferred. The dispersant to be mixed may be in an amount of from 1 to 20 parts by mass based on 100 parts by mass of the colorant, and much preferably from 2 to 10 parts by mass from the viewpoint of achievement of both dispersion stability and washing efficiency of toner particles. There are no particular limitations on the content of the colorant in the colorant water based dispersion, which may preferably be from about 1 to 30% by mass of the total mass of the colorant water based dispersion.

The colorant standing dispersed in the aqueous medium may have such particle diameter that, from the viewpoint of pigment dispersibility in the toner to be finally obtained, its volume distribution base 50% particle diameter (d50) is 0.5 μm or less and further preferably its volume distribution base 90% particle diameter (d90) is 2 μm or less. Dispersed-particle diameter of the colorant may be measured with a Doppler scattering particle size distribution measuring instrument (MICROTRACK UPA9340, manufactured by Nikkiso Co. Ltd.) or the like.

The known stirrer, emulsifier or dispersion machine used in dispersing the colorant may include, e.g., an ultrasonic homogenizer, a jet mill, a pressure homogenizer, a colloid mill, a ball mill, a sand mill and a paint shaker, any of which may be used alone or in combination.

The surface active agent may include, e.g., anionic surface active agents such as a sulfate type, a sulfonate type, a phosphate type and a soap type; cationic surface active agents such as an amine type and a quaternary ammonium type; and nonionic surface active agents such as a polyethylene glycol type, an alkyl phenol ethylene oxide addition product type and a polyhydric alcohol type. Of these, a nonionic surface active agent and/or an anionic surface active agent is/are preferred. The nonionic surface active agent may be used in combination with the anionic surface active agent. The surface active agent may be used alone, or may be used in combination of two or more types. Concentration of the surface active agent in the aqueous medium may preferably be so controlled as to be from about 0.5% by mass to about 5% by mass.

The release agent used in the present invention may preferably be one having a melting point of 150° C. or less, much preferably from 40° C. or more to 130° C. or less, and particularly preferably from 40° C. or more to 110° C. or less.

The release agent may include, but is not particularly limited to, e.g., low-molecular weight polyolefins such as polyethylene; silicones having melting point (softening point) by heating; fatty acid amides such as oleic acid amide, erucic acid amide, ricinolic acid amide and stearic acid amide; ester waxes such as stearyl stearate; vegetable waxes such as carnauba wax, rice wax, candelilla wax, japan wax (haze wax) and jojoba wax; animal waxes such as bees wax; mineral or petroleum waxes such as montan wax, ozokelite, serecin, paraffin wax, microcrystalline wax, Fischer-Tropsh wax and ester waxes; and modified products of these. Any of these may be used alone, or may be used in the form of a mixture of two or more types of release agents.

The release agent dispersion (water based dispersion) may be prepared by any known process given below, which is by no means limited to these methods.

For example, the release agent dispersion may be prepared by adding the release agent to an aqueous medium (the same one as above) containing the same surface active agent as above, heating the resultant mixture to a temperature not lower than the melting point of the release agent and at the same time putting this mixture to dispersion in the form of particles by means of a homogenizer having strongly shearing ability (e.g., "CLEAMIX W MOTION", manufactured by M$_{TECHNIQUE}$ Co., LTD.) or a pressure ejection dispersion machine (e.g., "GAULIN Homogenizer", manufactured by Gaulin Co.), followed by cooling to a temperature not higher than the melting point.

The release agent dispersion may preferably have a volume distribution base 50% particle diameter D50 (dispersed-particle diameter) of from 80 nm to 500 nm, and much preferably from 100 nm to 300 nm. It is also preferable that any coarse particles of 600 nm or more in diameter are not present therein. If the release agent dispersion has too small dispersed-particle diameter, the release agent may insufficiently dissolve out at the time of fixing to make the toner have a low hot offset temperature. If it has too large dispersed-particle diameter, the release agent may come bare to the toner particle surfaces to make the toner have low powder characteristics or cause photosensitive member filming. Also, the presence of such coarse particles may make the toner compositionally non-uniform or may make the release agent come to be liberated from toner particles. This dispersed-particle diameter may be measured with a Doppler scattering particle size distribution measuring instrument (MICROTRACK UPA9340, manufactured by Nikkiso Co. Ltd.) or the like.

It is preferable that the proportion of the surface active agent to the release agent in the release agent dispersion is from 1% by mass or more to 20% by mass or less. If the surface active agent is in too small proportion, the release agent may not sufficiently be dispersed to make the dispersion have a poor storage stability. If the surface active agent is in too large proportion, the toner may come poor in its charging performance, in particular, environmental stability.

The release agent may be used by adding it in an amount of from 1 to 30 parts by mass based on 100 parts by mass of the binder resin.

Solid matter concentration of the mixed dispersion obtained in the mixing step may optionally appropriately be controlled by adding water thereto. Its solid matter may preferably be in a concentration of from 5% by mass to 40% by mass, much preferably from 5% by mass to 30% by mass, and particularly preferably from 5% by mass to 20% by mass, in order to make uniform agglomeration take place in the core agglomeration step described next.

(B) Core Agglomeration Step:

Next, to the mixed dispersion obtained in the step (A), an agglomerating agent is added and mixed therein, and heat and mechanical powder or the like are appropriately applied thereto to form agglomerated particles.

As the agglomerating agent, a surface active agent, an inorganic metal salt and/or a divalent or more metal complex may be used which has/have a polarity reverse to that of the surface active agent contained in the mixed dispersion described above. It is an agent by which the acidic group of binder resin (1) and the ionic surface active agents used in the binder resin-(1) dispersion, colorant dispersion and release agent dispersion are ionically neutralized to make particles agglomerate by the effect of salting-out and ionic cross-linking. Stated specifically, it may include, but is not particularly limited to, e.g., monovalent inorganic metal salts such as sodium chloride, sodium sulfate and potassium chloride; divalent inorganic metal salts such as calcium chloride, calcium nitrate, magnesium chloride, magnesium sulfate and zinc chloride; trivalent metal salts such as iron(III) chloride, iron(III) sulfate, aluminum sulfate and aluminum chloride; and inorganic metal salt polymers such as aluminum polychloride, aluminum polyhydroxide and calcium polysulfide. Of these, divalent or more metal salts and polymers thereof may preferably be used because they are effective even in their addition in a small quantity and also have a high agglomerative force. Any of these may be used alone, or may be used in combination of two or more types.

The agglomerating agent may be added in any form of a dried powder and an aqueous solution prepared by dissolving it in an aqueous medium. In order to make uniform agglomeration take place, it may preferably be added in the form of an aqueous solution. The agglomerating agent may also preferably be added and mixed at a temperature not higher than the glass transition temperature of the binder resin (1) contained in the mixed dispersion described above. Where the mixing is carried out under such temperature conditions, the agglomeration proceeds uniformly. This mixing may be carried out by using any known mixing apparatus, homogenizer, mixer or the like.

In the agglomeration step, besides the foregoing, a known material such as a charge control agent may also be added. In such a case, the material to be added is required to have a volume average particle diameter of 1 μm or less, and preferably from 0.01 μm to 1 μm. If it has a volume average particle diameter of more than 1 μm, the core agglomerated particles obtained may have a broad particle size distribution, or particles may unwantedly come to be liberated due to such a material. This volume average particle diameter may be measured with a Doppler scattering particle size distribution measuring instrument (MICROTRACK UPA9340, manufactured by Nikkiso Co. Ltd.) or the like.

A means for preparing a dispersion of such an additional material may include, but is not particularly limited to, e.g., known dispersion machines such as a rotary shearing homogenizer, and a ball mill, a sand mill or Dyno mill, having agitation media, and the same apparatus as that for preparing the release agent dispersion, any of which may be used under selection of what is optimal for the material.

As average particle diameter of the core agglomerated particles to be formed here, there are no particular limitations thereon. Usually, it may be so controlled that the core-shell agglomerated particles formed as a result of the shell adhering step (D), detailed later, may have substantially the same average particle diameter as the toner intended to be finally obtained. The particle diameter of the core agglomerated particles may readily be controlled by, e.g., appropriately setting or changing temperature, solid-matter concentration, concentration of the agglomerating agent, stirring conditions and so forth.

(C) Metal Salt Loading Step (Preparation of Metal Salt Loaded Resin Dispersion):

The resin-(2) dispersion in which the resin (2) for forming shell layers stands dispersed and a metal salt soluble in a dispersion medium of the resin-(2) dispersion are mixed to prepare a metal salt loaded resin dispersion. The resin (2) for forming shell layers and the metal salt may each make use of any of specific compounds described later.

(D) Shell Adhering Step:

Next, to the dispersion in which the core agglomerated particles stand dispersed, the metal salt loaded resin dispersion prepared in the step (C) is added and mixed therein, and heat and mechanical powder or the like are appropriately applied thereto to form core-shell agglomerated particles.

As the resin (2) making up shell layers, there are no particular limitations thereon, and, like the binder resin (1), any known resins used for toners may be used, as exemplified by polyesters, vinyl polymers such as a styrene-acrylic copolymer, epoxy resins, polycarbonates and polyurethanes. In particular, polyesters or a styrene-acrylic copolymer is/are preferred, and polyesters are much preferable from the viewpoint of compatibility with the colorant and fixing performance and running performance of the toner. The polyesters have, where they have a rigid aromatic ring in the backbone chain, a flexibility as compared with the vinyl polymers such as a styrene-acrylic copolymer, and hence can provide an mechanical strength equivalent to that of the vinyl polymers even though having a lower molecular weight than the latter. Thus, the polyesters are preferred also as resins suited for low-temperature fixing performance.

In the present invention, the above resin (2) may be used alone, or may be used in combination of two or more types. Where the resin (2) contains any polyester, the polyester may be either of crystallizable one and non-crystallizable one. The non-crystallizable polyester is preferable from the viewpoint of fluidity, offset prevention and running performance of the toner. The crystallizable polyester has a sharp-melt property attributable to its crystallizability, and hence has an advantage in regard to low-temperature fixing performance, but has a disadvantage that it is inferior in powder fluidity and image strength. Accordingly, the non-crystallizable polyester is much preferable as a chief component of the resin (2). Whether or not it is crystallizable or non-crystallizable may be distinguished by differential scanning calorimetry (DSC) of the polyester to examine what glass transition temperature and melting point it has.

The resin (2) used in the present invention may be a resin containing an acidic polar group, which resin may preferably be used from the viewpoint of a good dispersion stability of resin particles and a colorant dispersibility in the toner. Such an acidic polar group may include a carboxyl group, a sulfonic acid group, a phosphonic acid group and a sulfinic acid group. In particular, a carboxyl group or a sulfonic acid group is preferable from the viewpoint of dispersion stability of resin particles. Also, in order that the resin particles can have good dispersion stability and a toner with small particle diameter can be obtained in a sharp particle size distribution, the resin (2) may preferably have an acid value of from 5 to 50 mgKOH/g, and much preferably from 10 to 30 mgKOH/g. If the resin (2) has an acid value of less than 5 mgKOH/g, any good dispersion stability is not achievable and, if the resin (2) has an acid value of more than 50 mgKOH/g, a low moisture resistance may result; such problems may come about.

The resin (2) used in the present invention makes up the shell layers, and may take account of blocking resistance from the viewpoint of functional separation thereof from the core particles. It may preferably have such glass transition temperature that glass transition temperature Tg1 of the binder resin (1) and glass transition temperature Tg2 of the resin (2) satisfy the relationship of 30° C.<Tg1<60° C.<Tg2<80° C. Further, it may much preferably have glass transition temperature satisfying the relationship of 30° C.<Tg1<60° C.<Tg2<75° C. If the glass transition temperature Tg2 is lower than 60° C. (or lower than the glass transition temperature Tg1), a problem may come about such that the toner obtained has a low blocking resistance. If on the other hand the Tg2 is higher than 80° C., the toner may inevitably have higher fixing temperature correspondingly thereto, and hence may come into question in view of its low-temperature fixing performance.

The resin (2) dispersion (water based dispersion) may be prepared by any of the same processes as the binder resin-(1) dispersion described previously (such as phase inversion emulsification, forced emulsification, emulsification polymerization and self-emulsification), which is by no means limited to these methods.

The resin (2) making up shell layers may preferably be in an amount of from 5 to 100 parts by mass, much preferably from 5 to 50 parts by mass, and particularly preferably from 10 to 30 parts by mass, based on 100 parts by mass of the binder resin (1). Where the resin (2) making up shell layers is contained in an amount within the above range, based on that of the binder resin (1) making up core particles, the core agglomerated particles can well stand covered with the resin (2), so that the toner can enjoy better blocking resistance and also can maintain good low-temperature fixing performance.

The resin (2) dispersion is previously mixed with the metal salt in the above step (C). This causes the salting-out and ionic cross-linking to take place and, in virtue of electrostatic neutralization, lowers any electrostatic effect of dispersion stabilization (zeta-potential) of particles of the resin (2) to bring the resin (2) readily strongly adherent to the core agglomerated particles in this step (D). Hence, any floating particles not adhering thereto can be kept from coming about, and the core agglomerated particles can uniformly be coated with the resin. Further, when the core-shell agglomerated particles are stabilized in the fusion step (E), detailed later, the core-shell agglomerated particles come to be fused while the shell layers having adhered to the core particles are kept to strongly adhere thereto without being liberated therefrom, and hence a toner is obtained the core particles of which have well been coated with the resin (2) making up the shell layers.

As the metal salt, any known metal salt may be used, which is formed by neutralization of an acid and a base. There are no particular limitations thereon as long as it is soluble in dispersion mediums. It may include the following.

Stated specifically, it may include, but is not particularly limited to, e.g., monovalent inorganic metal salts such as sodium chloride, sodium sulfate and potassium chloride; divalent inorganic metal salts such as calcium chloride, calcium nitrate, magnesium chloride, magnesium sulfate and zinc chloride; and trivalent metal salts such as iron(III) chloride, iron(III) sulfate, aluminum sulfate and aluminum chloride. Of these, polyvalent metal salts may preferably be used because they are effective even in their addition in a small quantity and also promise a strong adhesion of the resin-(2) particles making up the shell layers. In particular, divalent metal salts are preferable from the viewpoint that such a strong adhesion may readily make coarse agglomeration take place between the resin-(2) particles themselves. Metal salts are also grouped into acid salts, neutral salts and basic salts. From the viewpoint of causing electrostatic neutralization to take place to lower the dispersion stabilization of the resin-(2) particles, acid salts and neutral salts may preferably be used where the resin (2) has an acidic group or stands dispersed by using an anionic surface active agent. Any of these may be used alone, or may be used in combination of two or more types.

The metal salt may be added to the resin-(2) dispersion in the form of a dried powder or in the form of an aqueous solution prepared by dissolving it in an aqueous medium. In order to effect uniform mixing, however, it may preferably be added in the form of an aqueous solution prepared by dissolving the metal salt in an aqueous medium. The metal salt may also preferably be added and mixed at a temperature not higher than the glass transition temperature (Tg2) of the resin (2). The mixing may be carried out by using any known mixing apparatus, homogenizer, mixer or the like.

The amount of the metal salt to be added may differ depending on the acidic group of the resin (2), the acid value and particle diameter thereof and the valence of the metal salt, and can not absolutely be prescribed. It may be added under appropriate control so made as not to cause any floating particles. It is preferable for the metal salt to be so added as to be in a concentration not higher than critical agglomeration concentration because, if any agglomeration between particles of the resin (2) making up shell layers has come to take place, the core agglomerated particles tend to be non-uniformly covered with the shell layers.

The critical agglomeration concentration referred to here is an index relating to the stability of dispersed matter in the dispersion and shows concentration at which the agglomeration takes place with addition of the metal salt. This critical agglomeration concentration may greatly differ depending on a latex itself and a dispersant. It is described in, e.g., "Polymer Chemistry" 17, by Seizo Okamura et al., p. 601, 1960. Its value can be known according to such description.

This shell adhering step may also be carried out multi-stepwise, whereby a core-shell toner of multi-layer structure can also be produced.

The resin-(2) dispersion may preferably have a volume distribution base 50% particle diameter D50 (dispersed-particle diameter) of from 50 nm to 500 nm, and much preferably from 80 nm to 200 nm. It is also preferable that any coarse particles of 600 nm or more in diameter are not present therein. If the resin-(2) dispersion has a dispersed-particle diameter of less than 50 nm, the dispersion may come to be unstable at the stage where the metal salt has been mixed, to unwantedly cause agglomeration to take place between the resin-(2) particles themselves. If it has a dispersed-particle diameter of more than 500 nm, the resin-(2) particles which are to adhere to the core particles are so highly bulky that the surfaces of the core particles may partly come bare.

The mixture of the resin-(2) dispersion and the metal salt may preferably be in a solid matter concentration of from 5% by mass to 50% by mass, and much preferably from 20% by mass to 40% by mass. If the mixture is in a solid matter concentration of less than 5% by mass, it may unwantedly be dropwise added to the core-shell agglomerated particles in a large quantity to affect the concentration and temperature in the system undesirably. If on the other hand the mixture is in a solid matter concentration of more than 50% by mass, the mixture increases in viscosity, and hence, even though the mixture is added to the core agglomerated particles, any local agglomeration may come to take place to produce agglomerated particles of the resin-(2) particles themselves undesirably.

(E) Fusion Step:

Next, with stirring like that in the shell adhering step (D), a stabilizing agent such as a dispersion stabilizer, a pH adjuster or a chelating agent is added to an aqueous medium containing the core-shell agglomerated particles obtained in the shell adhering step (D), to stabilize the core-shell agglomerated particles and thereafter this is heated at a temperature not lower than the glass transition temperatures (Tg1, Tg2) of the binder resin (1) and resin (2) to make the core-shell agglomerated particles fuse and join together. Any of these stabilizing agents may be used alone, or may be used in combination. In particular, a chelating agent may preferably be used because it is also effective in keeping any metal-bridging from occurring in the toner.

As the dispersion stabilizer, any known agent may be used, as exemplified by a surface active agent, a high-molecular dispersant or the like, or an agent synthesized newly for the present invention may also be used. Any dispersion stabilizer can be removed in a toner washing step described later. From the viewpoint of washing efficiency, however, a surface active agent described below is preferred. Of the surface active agent, an anionic surface active agent, a nonionic surface active agent or the like is preferred. The dispersion stabilizer to be mixed may be in an amount of from 1 to 20 parts by mass based on 100 parts by mass of the core-shell agglomerated particles, and much preferably from 2 to 10 parts by mass from the viewpoint of achievement of both re-stabilization from the state of agglomeration and washing efficiency of toner particles.

The pH adjuster may include alkalis such as ammonia and sodium hydroxide, and acids such as nitric acid and citric acid.

As the chelating agent, there are no particular limitations thereon as long as it is a known chelating agent. For example, preferably usable are oxycarboxylic acids such as tartaric acid, citric acid and gluconic acid, and sodium salts of these; and iminodiacid (IDA), nitrilotriacetic acid (NTA), ethylenediaminetetraacetic acid (EDTA), and sodium salts of these. The chelating agent may be coordinated to metal ions of the agglomerating agent present in the aqueous medium, and this enables the particles to be stabilized into an electrostatically stable state from any electrostatically unstable agglomerated state. The chelating agent to be mixed may preferably be in an amount of from 1 to 30 parts by mass based on 100 parts by mass of the core-shell toner, and much preferably from 2.5 to 15 parts by mass from the viewpoint of achievement of both re-stabilization from the state of agglomeration and washing efficiency of toner particles.

As temperature for the heating, it may be any temperature as long as it is in the range of from the glass transition temperatures (Tg1, Tg2) of the binder resin (1) and resin (2) to the decomposition temperature of the resin.

As time for the heating, a short time may be sufficient where the heating is at a high temperature, and a long time is necessary where the heating is at a low temperature. More specifically, the time for the fusion depends on the temperature for the heating, and hence it can not absolutely be prescribed, but may commonly be in the range of from 30 minutes to 10 hours. Having come to have a stated average circularity, the core-shell agglomerated particles are cooled to room temperature under appropriate conditions. The average circularity of toner is measured with a flow type particle image analyzer "FPIA-3000" (manufactured by Sysmex Corporation) according to an operation manual attached to the instrument.

The core-shell agglomerated particles obtained after the fusion step has been completed are put to washing, filtration, drying and so forth to obtain toner particles.

In the washing, it is preferable to use pure water having a conductivity of 30 μS/cm or less. It is also preferable to wash the core-shell agglomerated particles until the supernatant of the water with which the core-shell agglomerated particles have been washed comes to have a conductivity of 100 μS/cm or less, and it is much preferable to wash the core-shell agglomerated particles until the supernatant of the water with which the core-shell agglomerated particles have been washed comes to have a conductivity of 50 μS/cm or less. Not only the washing with such pure water, but also the step of washing with any water may be carried out at least once the pH of which has appropriately been adjusted according to the kind and so forth of impurities intended to be remove. The core-shell agglomerated particles are thus washed in order to remove impurities other than tone components, such as any surface active agent that may especially affect the charging performance and environmental stability of the toner and any unnecessary agglomerating agent, metal salt and so forth having not participated in the agglomeration. By going through this washing step, a toner not containing any unnecessary components can be produced with ease.

To the surfaces of the toner particles thus obtained through washing and drying, any of all sorts of inorganic particles usually used as external additives to the toner particle surfaces, such as silica, alumina, titania or calcium carbonate particles, and all sorts of organic particles usually used as external additives to the toner particle surfaces, such as vinyl resin, polyester resin, silicone resin or fluorine resin particles, may for example be made to adhere or stick by applying shear force thereto by means of Henschel mixer or the like in a dry condition.

Such inorganic particles and organic particles function as external additives such as a fluidity improver, a cleaning aid and an abrasive. A lubricant may further be added to the toner particles. The lubricant may include, e.g., fatty acid amides such as ethylene bis(stearic acid) amide and oleic acid amide, fatty acid metal salts such as zinc stearate and calcium stearate, and higher alcohols such as UNILIN (registered trademark; available from Toyo-Petrolite Co., Ltd.). These are commonly added for the purpose of improving cleaning performance, and those having a primary particle diameter of from 0.1 μm to 5.0 μm may be used.

The toner that can be produced by using the core-shell toner production process of the present invention is described below.

The toner of the present invention may preferably have a weight average particle diameter (D4) of from 2 μm to 10 μm, much preferably from 2 μm to 8 μm, and particularly preferably from 3 μm to 8 μm. The toner having a weight average particle diameter of 2 μm or more is preferable because it can have an appropriate adhesion and has a superior developing performance. Also, the toner having a weight average particle diameter of 10 μm or less is preferable because it promises a superior resolution of images.

The toner of the present invention may preferably have shell layers having an average thickness of from 0.05 μm to 1 μm, and much preferably from 0.1 μm to 0.5 μm from the viewpoint of low-temperature fixing performance and blocking resistance. The average thickness of the shell layers may be measured by cross-sectional observation of toner particles by using a transmission electron microscope (TEM).

The toner of the present invention may preferably have an average circularity of from 0.90 to 0.99, and much preferably from 0.94 to 0.98 from the viewpoint of its fluidity and transfer performance.

How to measure various physical properties referred to in the present invention is described below.

Measurement of Acid Value of Resin:

The acid value of the binder resin (1) and resin (2) each is determined in the following way. Basic operation is made according to JIS K0070. The acid value refers to the number of milligrams of potassium hydroxide necessary to neutralize free fatty acid, resin acid and the like contained in 1 g of a sample.

(1) Reagent (a) Solvent: An ethyl ether/ethyl alcohol mixture solution (1+1 or 2+1) or a benzene/ethyl alcohol mixture solution (1+1 or 2+1) is used, which is, immediately before use, kept neutralized with a 0.1 mol/liter potassium hydroxide ethyl alcohol solution using phenolphthalein as an indicator.

(b) Phenolphthalein solution: 1 g of phenolphthalein is dissolved in 100 ml of ethyl alcohol (95 v/v %).

(c) 0.1 mol/liter potassium hydroxide/ethyl alcohol solution: 7.0 g of potassium hydroxide is dissolved in water used in a quantity as small as possible, and ethyl alcohol (95 v/v %) is added thereto to make up a 1 liter solution, which is then left for 2 or 3 days, followed by filtration. Standardization is made according to JIS K8006 (basic items relating to titration during a reagent content test).

(2) Operation

From 1 to 20 g of the binder resin (sample) is precisely weighed out, and 100 ml of the solvent and few drops of the phenolphthalein solution as an indicator are added thereto, which are then thoroughly shaken until the sample dissolves completely. In the case of a solid sample, it is dissolved by heating on a water bath. After cooling, the resultant solution is titrated with the 0.1 mol/liter potassium hydroxide ethyl alcohol solution, and the time by which the indicator has stood sparingly red for 30 seconds is regarded as the end point of neutralization.

(3) Calculation

Acid value A is calculated from the following equation.

$$A=(B\times f\times 5.611)/S$$

where;

B: the amount (ml) of the 0.1 mol/liter potassium hydroxide ethyl alcohol solution used;

f: the factor of the 0.1 mol/liter potassium hydroxide ethyl alcohol solution; and S: the sample (g).

Measurement of Particle Size Distribution of Fine Particles of Binder Resin Particles, etc.:

The particle size distribution of fine particles of binder resin particles and the like is measured with a laser diffraction/scattering particle size distribution measuring instrument (LA-920, manufactured by Horiba Ltd.) according to an operation manual attached to the instrument.

Stated specifically, at the sample inlet of the measuring instrument, a measuring sample is so controlled as to have a transmittance within the range of measurement (70% to 95%), and its volume distribution is measured.

The volume distribution base 50% particle diameter is particle diameter (median diameter) corresponding to cumulative 50%.

Measurement of number average particle diameter (D1) and weight average particle diameter (D4) of toner:

The number average particle diameter (D1) and weight average particle diameter (D4) of the toner are measured by particle size distribution analysis according to the Coulter method. COULTER COUNTER TA-II or COULTER MULTISIZER III (manufactured by Beckman Coulter, Inc.) is used as a measuring instrument, and measurement is made according to an operation manual attached to the instrument. As an electrolytic solution, an aqueous about-1% NaCl solution is prepared using first-grade sodium chloride. For example, ISOTON R-II (available from Coulter Scientific Japan Co.) may be used. As a specific measuring method, 0.1 to 5 ml of a surface active agent (preferably an alkylbenzenesulfonate) is added as a dispersant to 100 to 150 ml of the above aqueous electrolytic solution, and 2 to 20 mg of a sample (toner) for measurement is further added. The electrolytic solution in which the sample has been suspended is subjected to dispersion treatment for about 1 minute to about 3 minutes in an ultrasonic dispersion machine. The volume distribution and number distribution are calculated by measuring the volume and number of toner particles of 2.00 μm or more in diameter by means of the above measuring instrument, fitted with an aperture of 100 μm as its aperture. Then the number average particle diameter (D1) and weight average particle diameter (D4) (the middle value of each channel is used as the representative value for each channel) are determined.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

Observation of Toner Particle Cross Section:

Average thickness of the shell layers of toner particles is observed by using a transmission electron microscope (TEM). Stated specifically, the toner particles to be observed are sufficiently dispersed in epoxy resin, and thereafter the epoxy resin is cured for 2 days in an atmosphere of temperature 40° C. to obtain a cured product. Ultrathin pieces (thickness; 50 nm to 100 nm) of the cured product are prepared, where the thickness of the shell layers each in the visual field is observed on a photograph taken at 10,000 to 40,000 magnifications by the transmission electron microscope (TEM) to find their average thickness.

EXAMPLES

The present invention is described below in greater detail by giving working examples. Embodiments of the present invention are by no means limited to these.

Synthesis of Polyester Resin A:

| | |
|---|---|
| Polyoxypropylene(2.2)-2,2-bis(4-hydroxyphenyl)propane | 30 mole % |
| Polyoxyethylene(2.0)-2,2-bis(4-hydroxyphenyl)propane | 20 mole % |
| Terephthalic acid | 18 mole % |
| Fumaric acid | 18 mole % |
| Adipic acid | 10 mole % |
| Trimellitic acid | 4 mole % |

The above components were introduced into a two-necked flask having sufficiently been heated and dried, and 0.05 part by mass of dibutyltin oxide was added to 100 parts by mass of a mixture of the above, where nitrogen gas was fed into this flask to keep an inert atmosphere, during which the temperature was raised and then co-condensation polymerization reaction was carried out at 150 to 230° C. for about 12 hours. Thereafter, under reduced pressure, the temperature was raised to 210 to 250° C., where the co-condensation polymerization reaction was further carried out for 2 hours to synthesize a polyester resin, A.

The polyester resin A obtained had a weight average molecular weight (Mw) of 12,000 and a number average molecular weight (Mn) of 5,200 in its molecular weight (in terms of polystyrene) measured by GPC (gel permeation chromatography).

The glass transition temperature of the polyester resin A was also measured with a differential scanning calorimeter (DSC) to find that it was 45° C.

Synthesis of Polyester Resin B:

| | |
|---|---|
| Polyoxypropylene(2.2)-2,2-bis(4-hydroxyphenyl)propane | 30 mole % |
| Polyoxyethylene(2.0)-2,2-bis(4-hydroxyphenyl)propane | 20 mole % |
| Terephthalic acid | 13 mole % |
| Fumaric acid | 13 mole % |
| Adipic acid | 20 mole % |
| Trimellitic acid | 4 mole % |

The above components were introduced into a two-necked flask having sufficiently been heated and dried, and 0.05 part by mass of dibutyltin oxide was added to 100 parts by mass of a mixture of the above, where nitrogen gas was fed into this flask to keep an inert atmosphere, during which the temperature was raised and then co-condensation polymerization reaction was carried out at 150 to 230° C. for about 12 hours. Thereafter, under reduced pressure, the temperature was raised to 210 to 250° C., where the co-condensation polymerization reaction was further carried out for 2 hours to synthesize a polyester resin, B.

The polyester resin B obtained had a weight average molecular weight (Mw) of 10,800 and a number average molecular weight (Mn) of 4,900 in its molecular weight (in terms of polystyrene) measured by GPC (gel permeation chromatography).

The glass transition temperature of the polyester resin B was also measured with a differential scanning calorimeter (DSC) to find that it was 37° C.

Synthesis of Polyester Resin C:

| | |
|---|---|
| Polyoxypropylene(2.2)-2,2-bis(4-hydroxyphenyl)propane | 25 mole % |
| Polyoxyethylene(2.0)-2,2-bis(4-hydroxyphenyl)propane | 25 mole % |
| Terephthalic acid | 26 mole % |
| Fumaric acid | 20 mole % |
| Trimellitic acid | 4 mole % |

The above components were introduced into a two-necked flask having sufficiently been heated and dried, and 0.05 part by mass of dibutyltin oxide was added to 100 parts by mass of a mixture of the above, where nitrogen gas was fed into this flask to keep an inert atmosphere, during which the temperature was raised and then co-condensation polymerization reaction was carried out at 150 to 230° C. for about 12 hours. Thereafter, under reduced pressure, the temperature was raised to 210 to 250° C., where the co-condensation polymerization reaction was further carried out for 2 hours to synthesize a polyester resin, C.

The polyester resin C obtained had a weight average molecular weight (Mw) of 11,000 and a number average molecular weight (Mn) of 5,100 in its molecular weight (in terms of polystyrene) measured by GPC (gel permeation chromatography).

The glass transition temperature of the polyester resin C was also measured with a differential scanning calorimeter (DSC) to find that it was 56° C.

Synthesis of Polyester Resin D:

| | |
|---|---|
| Polyoxypropylene(2.2)-2,2-bis(4-hydroxyphenyl)propane | 30 mole % |
| Polyoxyethylene(2.0)-2,2-bis(4-hydroxyphenyl)propane | 20 mole % |
| Terephthalic acid | 18 mole % |
| Fumaric acid | 16.5 mole % |
| Adipic acid | 10 mole % |
| Sodium dimethyl isophthalate-5-sulfonate | 1.5 mole % |
| Trimellitic acid | 4 mole % |

The above components were introduced into a two-necked flask having sufficiently been heated and dried, and 0.05 part by mass of dibutyltin oxide was added to 100 parts by mass of a mixture of the above, where nitrogen gas was fed into this flask to keep an inert atmosphere, during which the temperature was raised and then co-condensation polymerization reaction was carried out at 150 to 230° C. for about 12 hours. Thereafter, under reduced pressure, the temperature was raised to 210 to 250° C., where the co-condensation polymerization reaction was further carried out for 2 hours to synthesize a polyester resin, D.

The polyester resin D obtained had a weight average molecular weight (Mw) of 11,600 and a number average molecular weight (Mn) of 4,900 in its molecular weight (in terms of polystyrene) measured by GPC (gel permeation chromatography).

The glass transition temperature of the polyester resin D was also measured with a differential scanning calorimeter (DSC) to find that it was 46° C.

Synthesis of Polyester Resin E:

| | |
|---|---|
| Polyoxypropylene(2.2)-2,2-bis(4-hydroxyphenyl)propane | 20 mole % |
| Polyoxyethylene(2.0)-2,2-bis(4-hydroxyphenyl)propane | 30 mole % |
| Terephthalic acid | 40 mole % |
| Fumaric acid | 5 mole % |
| Trimellitic acid | 5 mole % |

The above components were introduced into a two-necked flask having sufficiently been heated and dried, and 0.05 part by mass of dibutyltin oxide was added to 100 parts by mass of a mixture of the above, where nitrogen gas was fed into this flask to keep an inert atmosphere, during which the temperature was raised and then co-condensation polymerization reaction was carried out at 150 to 230° C. for about 12 hours. Thereafter, under reduced pressure, the temperature was raised to 210 to 250° C., where the co-condensation polymerization reaction was further carried out for 2 hours to synthesize a polyester resin, E.

The polyester resin E obtained had a weight average molecular weight (Mw) of 17,000 and a number average molecular weight (Mn) of 8,000 in its molecular weight (in terms of polystyrene) measured by GPC (gel permeation chromatography).

The glass transition temperature of the polyester resin E was also measured with a differential scanning calorimeter (DSC) to find that it was 66° C.

Synthesis of Polyester Resin F:

| | |
|---|---|
| Polyoxypropylene(2.2)-2,2-bis(4-hydroxyphenyl)propane | 20 mole % |
| Polyoxyethylene(2.0)-2,2-bis(4-hydroxyphenyl)propane | 30 mole % |
| Terephthalic acid | 40 mole % |
| Fumaric acid | 3.5 mole % |
| Sodium dimethyl isophthalate-5-sulfonate | 1.5 mole % |
| Trimellitic acid | 5 mole % |

The above components were introduced into a two-necked flask having sufficiently been heated and dried, and 0.05 part by mass of dibutyltin oxide was added to 100 parts by mass of a mixture of the above, where nitrogen gas was fed into this flask to keep an inert atmosphere, during which the temperature was raised and then co-condensation polymerization reaction was carried out at 150 to 230° C. for about 12 hours. Thereafter, under reduced pressure, the temperature was raised to 210 to 250° C., where the co-condensation polymerization reaction was further carried out for 2 hours to synthesize a polyester resin, F.

The polyester resin F obtained had a weight average molecular weight (Mw) of 16,600 and a number average molecular weight (Mn) of 7,800 in its molecular weight (in terms of polystyrene) measured by GPC (gel permeation chromatography).

The glass transition temperature of the polyester resin F was also measured with a differential scanning calorimeter (DSC) to find that it was 66° C.

Synthesis of Polyester Resin G:

| | |
|---|---|
| Polyoxypropylene(2.2)-2,2-bis(4-hydroxyphenyl)propane | 15 mole % |
| Polyoxyethylene(2.0)-2,2-bis(4-hydroxyphenyl)propane | 35 mole % |

-continued

| | |
|---|---|
| Terephthalic acid | 43.5 mole % |
| Sodium dimethyl isophthalate-5-sulfonate | 1.5 mole % |
| Trimellitic acid | 5 mole % |

The above components were introduced into a two-necked flask having sufficiently been heated and dried, and 0.05 part by mass of dibutyltin oxide was added to 100 parts by mass of a mixture of the above, where nitrogen gas was fed into this flask to keep an inert atmosphere, during which the temperature was raised and then co-condensation polymerization reaction was carried out at 150 to 230° C. for about 12 hours. Thereafter, under reduced pressure, the temperature was raised to 210 to 250° C., where the co-condensation polymerization reaction was further carried out for 2 hours to synthesize a polyester resin, G.

The polyester resin G obtained had a weight average molecular weight (Mw) of 23,100 and a number average molecular weight (Mn) of 11,000 in its molecular weight (in terms of polystyrene) measured by GPC (gel permeation chromatography).

The glass transition temperature of the polyester resin G was also measured with a differential scanning calorimeter (DSC) to find that it was 72° C.

Preparation of Water Based Dispersion of Polyester Resin A:

1,200 parts by mass of the polyester resin A and 0.5 part by mass of an anionic surface active agent (NEOGEN SC-A, available from Dai-ichi Kogyo Seiyaku Co., Ltd.) were dissolved in 2,400 parts by mass of THF (tetrahydrofuran), and thereafter dimethylaminoethanol was added thereto in an amount of 1 equivalent weight based on the acid value of the polyester resin A, followed by stirring for 10 minutes. Thereafter, with stirring by means of a homogenizer (ULTRATALUX T50, manufactured by IKA Works, Inc.) at a number of revolutions of 5,000 r/min, 3,600 parts by mass of ion-exchanged water was dropwise added on. The mixture obtained was treated under reduced pressure of 50 mmHg to remove the THF to obtain a water based dispersion of polyester resin A (solid matter concentration: 25% by mass; volume distribution base 50% particle diameter (d50): 120 nm).

Preparation of Water Based Dispersion of Polyester Resin B:

The procedure of the above preparation of water based dispersion of polyester resin A was repeated except to change the polyester resin A for the polyester resin B, to obtain a water based dispersion of polyester resin B (solid matter concentration: 25% by mass; volume distribution base 50% particle diameter (d50): 100 nm).

Preparation of Water Based Dispersion of Polyester Resin C:

The procedure of the above preparation of water based dispersion of polyester resin A was repeated except to change the polyester resin A for the polyester resin C, to obtain a water based dispersion of polyester resin C (solid matter concentration: 25% by mass; volume distribution base 50% particle diameter (d50): 107 nm).

Preparation of Water Based Dispersion of Polyester Resin D:

The procedure of the above preparation of water based dispersion of polyester resin A was repeated except to change the polyester resin A for the polyester resin D, to obtain a water based dispersion of polyester resin D (solid matter concentration: 25% by mass; volume distribution base 50% particle diameter (d50): 110 nm).

Preparation of Water Based Dispersion of Polyester Resin E:

The procedure of the above preparation of water based dispersion of polyester resin A was repeated except to change the polyester resin A for the polyester resin E, to obtain a water based dispersion of polyester resin E (solid matter concentration: 25% by mass; volume distribution base 50% particle diameter (d50): 120 nm).

Preparation of Water Based Dispersion of Polyester Resin F:

The procedure of the above preparation of water based dispersion of polyester resin A was repeated except to change the polyester resin A for the polyester resin F, to obtain a water based dispersion of polyester resin F (solid matter concentration: 25% by mass; volume distribution base 50% particle diameter (d50): 90 nm).

Preparation of Water Based Dispersion of Polyester Resin G:

The procedure of the above preparation of water based dispersion of polyester resin A was repeated except to change the polyester resin A for the polyester resin G, to obtain a water based dispersion of polyester resin G (solid matter concentration: 25% by mass; volume distribution base 50% particle diameter (d50): 100 nm).

Emulsion Polymerization for Copolymer A:

| | |
|---|---|
| Styrene | 300 parts by mass |
| n-Butyl acrylate | 150 parts by mass |
| Acrylic acid | 3 parts by mass |
| t-Dodecyl mercaptan | 10 parts by mass |

The above components were mixed to prepare a monomer solution. An aqueous surfactant solution prepared by dissolving 10 parts by mass of an anionic surface active agent (NEOGEN RK, available from Dai-ichi Kogyo Seiyaku Co., Ltd.) in 1,130 parts by mass of ion-exchanged water and the monomer solution were introduced into a two-necked flask, where these were stirred by means of a homogenizer (ULTRATALUX T50, manufactured by IKA Works, Inc.) at a number of revolutions of 10,000 r/min to effect emulsification. Thereafter, the internal atmosphere of the flask was displaced with nitrogen, followed by heating in a water bath with slow stirring until the contents came to 70° C. Thereafter, 7 parts by mass of ion-exchanged water in which 3 parts by mass of ammonium persulfate was dissolved was introduced thereinto to start polymerization. The reaction was continued for 8 hours, and thereafter the reaction solution formed was cooled to room temperature to consequently obtain a water based dispersion of a styrene-acrylic copolymer A having a volume distribution base 50% particle diameter of 150 nm, a glass transition temperature of 46.0° C., a weight average molecular weight Mw of 30,000 and an Mw/Mn of 2.6.

Emulsion Polymerization for Copolymer B:

The procedure of the emulsion polymerization for copolymer A was repeated except to change the acrylic acid for acrylamide-2-methylpropanesulfonic acid, to obtain a water based dispersion of a styrene-acrylic copolymer B having a volume distribution base 50% particle diameter of 170 nm, a glass transition temperature of 46.8° C., a weight average molecular weight Mw of 28,000 and an Mw/Mn of 2.6.

Emulsion Polymerization for Copolymer C:

The procedure of the emulsion polymerization for copolymer A was repeated except to use the styrene in an amount of 400 parts by mass and the n-butyl acrylate in an amount of 100 parts by mass, to obtain a water based dispersion of a styrene-acrylic copolymer C having a volume distribution base 50% particle diameter of 180 nm, a glass transition temperature of 66.0° C., a weight average molecular weight Mw of 31,000 and an Mw/Mn of 2.6.

Emulsion Polymerization for Copolymer D:

The procedure of the emulsion polymerization for copolymer A was repeated except to use the styrene in an amount of 400 parts by mass and the n-butyl acrylate in an amount of 100 parts by mass and change the acrylic acid for acrylamide-2-methylpropanesulfonic acid, to obtain a water based dispersion of a styrene-acrylic copolymer D having a volume distribution base 50% particle diameter of 150 nm, a glass transition temperature of 65.0° C., a weight average molecular weight Mw of 29,000 and an Mw/Mn of 2.6.

Preparation of Colorant Water Based Dispersion:

| | |
|---|---|
| Cyan pigment (C.I. Pigment Blue 15:3) | 100 parts by mass |
| Anionic surface active agent (NEOGEN RK, available from Dai-ichi Kogyo Seiyaku Co., Ltd.) | 10 parts by mass |
| Ion-exchanged water | 890 parts by mass |

The above materials were mixed, and then put to dispersion by means of a homogenizer (ULTRATALUX T50, manufactured by IKA Works, Inc.) at a number of revolutions of 24,000 r/min for 30 minutes. Thereafter, the dispersion was further carried out by means of a high-pressure impact dispersion nanomizer (manufactured by Yoshida Kikai Co., Ltd.) under a pressure condition of 200 MPa to prepare a colorant water based dispersion in which the cyan pigment stood dispersed. The colorant (cyan pigment) in the colorant water based dispersion had a volume distribution base 50% particle diameter of 0.12 μm and a colorant concentration of 10% by mass.

Preparation of Release Agent Water Based Dispersion:

| | |
|---|---|
| Ester wax (behenyl behenate; melting point: 75° C.) | 100 parts by mass |
| Anionic surface active agent (NEOGEN RK, available from Dai-ichi Kogyo Seiyaku Co., Ltd.) | 10 parts by mass |
| Ion-exchanged water | 880 parts by mass |

The above materials were introduced into a mixing container provided with a jacket, and thereafter heated to 90° C. and circulated by a constant-rate pump, during which the materials were stirred by means of a homogenizer CLEAMIX W MOTION (manufactured by $M_{TECHNIQUE}$ Co., LTD.) under conditions of a number of revolutions of 19,000 r/min for rotor and a number of revolutions of 19,000 r/min for screen to carry out dispersion treatment for 60 minutes. After the dispersion treatment for 60 minutes, the treated product was cooled to 40° C. subsequently under conditions of a number of revolutions of 1,000 r/min for rotor, a number of revolutions of 0 r/min for screen and a cooling rate of 10° C./min to obtain a release agent water based dispersion.

The particle diameter of a sample of this was measured with a laser diffraction/scattering particle size distribution measuring instrument (LA-920, manufactured by Horiba Ltd.) to find that the volume distribution base 50% particle diameter was 0.15 μm and coarse particles of 0.8 μm or more were 0.01% or less in content.

Example 1

Core Agglomeration Step:

| | |
|---|---|
| Water based dispersion of polyester resin A | 600 parts by mass |
| Colorant water based dispersion | 75 parts by mass |
| Release agent water based dispersion | 150 parts by mass |
| Aqueous 1% by mass magnesium sulfate solution | 150 parts by mass |
| Ion-exchanged water | 525 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 43° C. in a heating oil bath, using a stirring blade and controlling it appropriately at such a number of revolutions that the liquid mixture was stirred. The system was retained at 43° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.1 μm stood formed.

Metal Salt Loading Step (Preparation of Metal Salt Loaded Resin Dispersion):

180 parts by mass of the water based dispersion of polyester resin F and 10 parts by mass of an aqueous 1% by mass calcium chloride solution were mixed by means of a homogenizer (ULTRATALUX T50, manufactured by IKA Works, Inc.) at a number of revolutions of 5,000 r/min for 10 minutes to carry out dispersion to prepare a metal salt loaded resin dispersion).

Shell Adhering Step:

To the above core agglomerated particles, the above metal salt loaded resin dispersion was dropwise added to further carry out treatment at 43° C. for 1 hour. As a result, it was ascertained that core-shell agglomerated particles having a volume average particle diameter of about 5.5 μm stood formed. At this stage, the particles were sampled in a small quantity, and then filtered with a filter of 1 μm in pore size, whereupon it was ascertained that the filtrate formed was colorless and transparent and the polyester resin F added supplementally had adhered in its total mass to the core particles.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.4 μm and an average circularity of 0.980. Thereafter, this was cooled to room temperature and then filtered, whereupon it was ascertained that the filtrate formed was colorless and transparent and the polyester resin F did not come to be liberated in the fusion step. Thereafter, the matter filtered out was sufficiently washed with ion-exchanged water, followed by drying by means of a vacuum drier to obtain toner particles 1.

The particle diameter of the toner particles 1 was measured with COULTER MULTISIZER III (manufactured by Beckman Coulter, Inc.) to find that its weight average particle diameter D4 was 5.36 μm, and number average particle diameter D1, 4.65 μm. That is, the value of D4/D1 was 1.15, thus the toner particles 1 showed a sharp particle size distribution. The circularity of the toner particles 1 was also measured with the flow type particle image analyzer (FPIA-3000, manufactured by Sysmex Corporation) to find that it had an average circularity of 0.980.

Next, this toner particles 1 was mixed with 1.7% by mass of hydrophobic fine silica powder (primary average particle diameter: 0.01 μm) having a BET specific surface area of 200 $m^2/g$, to prepare a toner 1.

Examples 2 to 7

Toner particles 2 to 7 and toners 2 to 7 were obtained in the same way as in Example 1 except that the metal salt in the metal salt loading step (preparation of metal salt loaded resin dispersion) of Example 1 was changed for metal salts (aqueous 1% by mass solutions all) shown respectively in Table 1.

In all Examples, any floating particles that might come from unreacted and liberated particles of the polyester resin F added supplementally was not seen to have come about in the shell adhering step and fusion step.

Examples 8 to 10

Toner particles 8 to 10 and toners 8 to 10 were obtained in the same way as in Example 1 except that the water based dispersion of polyester resin F in the metal salt loading step (preparation of metal salt loaded resin dispersion) of Example 1 was changed for water based dispersions of resins shown respectively in Table 1.

In all Examples, any floating particles that might come from unreacted and liberated particles of the resin added supplementally was not seen to have come about in the shell adhering step and fusion step.

Example 11

Core Agglomeration Step:

| | |
|---|---|
| Water based dispersion of polyester resin B | 600 parts by mass |
| Colorant water based dispersion | 75 parts by mass |
| Release agent water based dispersion | 150 parts by mass |
| Aqueous 1% by mass calcium chloride solution | 300 parts by mass |
| Ion-exchanged water | 375 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 35° C. in a heating oil bath, using a stirring blade and controlling it appropriately at such a number of revolutions that the liquid mixture was stirred. The system was retained at 35° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.3 μm stood formed.

Metal Salt Loading Step (Preparation of Metal Salt Loaded Resin Dispersion):

180 parts by mass of the water based dispersion of polyester resin F and 10 parts by mass of an aqueous 1% by mass calcium chloride solution were mixed by means of a homogenizer (ULTRATALUX T50, manufactured by IKA Works, Inc.) at a number of revolutions of 5,000 r/min for 10 minutes to carry out dispersion to prepare a metal salt loaded resin dispersion).

Shell Adhering Step:

To the above core agglomerated particles, the above metal salt loaded resin dispersion was dropwise added to further carry out treatment at 35° C. for 1 hour. As a result, it was ascertained that core-shell agglomerated particles having a volume average particle diameter of about 5.6 μm stood formed. At this stage, the particles were sampled in a small quantity, and then filtered with a filter of 1 μm in pore size, whereupon it was ascertained that the filtrate formed was colorless and transparent and the polyester resin F added supplementally had adhered in its total mass to the core particles.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.6 μm and an average circularity of 0.980. Thereafter, this was cooled to room temperature and then filtered, whereupon it was ascertained that the filtrate formed was colorless and transparent and the polyester resin F did not come to be liberated in the fusion step. Thereafter, the matter filtered out was sufficiently washed with ion-exchanged water, followed by drying by means of a vacuum drier to obtain toner particles 11. The circularity of the toner particles 11 was measured with the flow type particle image analyzer (FPIA-3000, manufactured by Sysmex Corporation) to find that it had an average circularity of 0.980.

Next, this toner particles 11 was mixed with 1.7% by mass of hydrophobic fine silica powder (primary average particle diameter: 0.01 μm) having a BET specific surface area of 200 $m^2/g$, to prepare a toner 11.

Example 12

Core Agglomeration Step:

| | |
|---|---|
| Water based dispersion of polyester resin C | 600 parts by mass |
| Colorant water based dispersion | 75 parts by mass |
| Release agent water based dispersion | 150 parts by mass |
| Aqueous 1% by mass calcium chloride solution | 300 parts by mass |
| Ion-exchanged water | 375 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 52° C. in a heating oil bath, using a stirring blade and controlling it appropriately at such a number of revolutions that the liquid mixture was stirred. The system was retained at 52° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.1 μm stood formed.

Metal Salt Loading Step (Preparation of Metal Salt Loaded Resin Dispersion):

180 parts by mass of the water based dispersion of polyester resin F and 10 parts by mass of an aqueous 1% by mass calcium chloride solution were mixed by means of a homogenizer (ULTRATALUX T50, manufactured by IKA Works, Inc.) at a number of revolutions of 5,000 r/min for 10 minutes to carry out dispersion to prepare a metal salt loaded resin dispersion).

Shell Adhering Step:

To the above core agglomerated particles, the above metal salt loaded resin dispersion was dropwise added to further carry out treatment at 52° C. for 1 hour. As a result, it was ascertained that core-shell agglomerated particles having a volume average particle diameter of about 5.4 μm stood formed. At this stage, the particles were sampled in a small quantity, and then filtered with a filter of 1 μm in pore size, whereupon it was ascertained that the filtrate formed was colorless and transparent and the polyester resin F added supplementally had adhered in its total mass to the core particles.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.4 μm and an average circularity of 0.980. Thereafter, this was cooled to room temperature and then filtered, whereupon it was ascertained that the filtrate formed was colorless and transparent and the polyester resin F did not come to be liberated in the fusion step. Thereafter, the matter filtered out was sufficiently washed with ion-exchanged water, followed by drying by means of a vacuum drier to obtain toner particles 12. The circularity of the toner particles 12 was measured with the flow type particle image analyzer (FPIA-3000, manufactured by Sysmex Corporation) to find that it had an average circularity of 0.980.

Next, this toner particles 12 was mixed with 1.7% by mass of hydrophobic fine silica powder (primary average particle diameter: 0.01 μm) having a BET specific surface area of 200 $m^2/g$, to prepare a toner 12.

Example 13

Core Agglomeration Step:

| | |
|---|---|
| Water based dispersion of polyester resin D | 600 parts by mass |
| Colorant water based dispersion | 75 parts by mass |
| Release agent water based dispersion | 150 parts by mass |
| Aqueous 1% by mass calcium chloride solution | 300 parts by mass |
| Ion-exchanged water | 375 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 45° C. in a heating oil bath, using a stirring blade and controlling it appropriately at such a number of revolutions that the liquid mixture was stirred. The system was retained at 45° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.2 μm stood formed.

Metal Salt Loading Step (Preparation of Metal Salt Loaded Resin Dispersion):

180 parts by mass of the water based dispersion of polyester resin F and 10 parts by mass of an aqueous 1% by mass calcium chloride solution were mixed by means of a homogenizer (ULTRATALUX T50, manufactured by IKA Works, Inc.) at a number of revolutions of 5,000 r/min for 10 minutes to carry out dispersion to prepare a metal salt loaded resin dispersion).

Shell Adhering Step:

To the above core agglomerated particles, the above metal salt loaded resin dispersion was dropwise added to further carry out treatment at 45° C. for 1 hour. As a result, it was ascertained that core-shell agglomerated particles having a volume average particle diameter of about 5.5 μm stood formed. At this stage, the particles were sampled in a small quantity, and then filtered with a filter of 1 μm in pore size, whereupon it was ascertained that the filtrate formed was colorless and transparent and the polyester resin F added supplementally had adhered in its total mass to the core particles.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.4 μm and an average circularity of 0.980. Thereafter, this was cooled to room temperature and then filtered, whereupon it was ascertained that the filtrate formed was colorless and transparent and the polyester resin F did not come to be liberated in the fusion step. Thereafter, the matter filtered out was sufficiently washed with ion-exchanged water, followed by drying by means of a vacuum drier to obtain toner particles 13. The circularity of the toner particles 13 was measured with the flow type particle image analyzer (FPIA-3000, manufactured by Sysmex Corporation) to find that it had an average circularity of 0.980.

Next, this toner particles 13 was mixed with 1.7% by mass of hydrophobic fine silica powder (primary average particle diameter: 0.01 μm) having a BET specific surface area of 200 $m^2/g$, to prepare a toner 13.

Examples 14 & 15

Toner particles 14 and 15 and toners 14 and 15 were obtained in the same way as in Example 13 except that the water based dispersion of polyester resin F in the metal salt loading step (preparation of metal salt loaded resin dispersion) of Example 13 was changed for water based dispersions of resins shown respectively in Table 1.

In all Examples, any floating particles that might come from unreacted and liberated particles of the resin added supplementally was not seen to have come about in the shell adhering step and fusion step.

Example 16

Core Agglomeration Step:

| | |
|---|---|
| Water based dispersion of styrene-acrylic copolymer A | 600 parts by mass |
| Colorant water based dispersion | 75 parts by mass |
| Release agent water based dispersion | 150 parts by mass |
| Aqueous 1% by mass calcium chloride solution | 300 parts by mass |
| Ion-exchanged water | 375 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 45° C. in a heating oil bath, using a stirring blade and controlling it appropriately at such a number of revolutions that the liquid mixture was stirred. The system was retained at 45° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.2 μm stood formed.

Metal Salt Loading Step (Preparation of Metal Salt Loaded Resin Dispersion):

180 parts by mass of the water based dispersion of polyester resin F and 10 parts by mass of an aqueous 1% by mass calcium chloride solution were mixed by means of a homogenizer (ULTRATALUX T50, manufactured by IKA Works, Inc.) at a number of revolutions of 5,000 r/min for 10 minutes to carry out dispersion to prepare a metal salt loaded resin dispersion).

Shell Adhering Step:

To the above core agglomerated particles, the above metal salt loaded resin dispersion was dropwise added to further carry out treatment at 45° C. for 1 hour. As a result, it was ascertained that core-shell agglomerated particles having a volume average particle diameter of about 5.6 μm stood formed. At this stage, the particles were sampled in a small quantity, and then filtered with a filter of 1 μm in pore size, whereupon it was ascertained that the filtrate formed was colorless and transparent and the polyester resin F added supplementally had adhered in its total mass to the core particles.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.5 μm and an average circularity of 0.980. Thereafter, this was cooled to room temperature and then filtered, whereupon it was ascertained that the filtrate formed was colorless and transparent and the polyester resin F did not come to be liberated in the fusion step. Thereafter, the matter filtered out was sufficiently washed with ion-exchanged water, followed by drying by means of a vacuum drier to obtain toner particles 16. The circularity of the toner particles 16 was measured with the flow type particle image analyzer (FPIA-3000, manufactured by Sysmex Corporation) to find that it had an average circularity of 0.980.

Next, this toner particles 16 was mixed with 1.7% by mass of hydrophobic fine silica powder (primary average particle diameter: 0.01 μm) having a BET specific surface area of 200 $m^2/g$, to prepare a toner 16.

Examples 17 & 18

Toner particles 17 and 18 and toners 17 and 18 were obtained in the same way as in Example 16 except that the water based dispersion of polyester resin F in the metal salt loading step (preparation of metal salt loaded resin dispersion) of Example 16 was changed for water based dispersions of resins shown respectively in Table 1.

In all Examples, any floating particles that might come from unreacted and liberated particles of the resin added supplementally was not seen to have come about in the shell adhering step and fusion step.

Example 19

Core Agglomeration Step:

| | |
|---|---|
| Water based dispersion of styrene-acrylic copolymer B | 600 parts by mass |
| Colorant water based dispersion | 75 parts by mass |
| Release agent water based dispersion | 150 parts by mass |
| Aqueous 1% by mass calcium chloride solution | 300 parts by mass |
| Ion-exchanged water | 375 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 45° C. in a heating oil bath, using a stirring blade and controlling it appropriately at such a number of revolutions that the liquid mixture was stirred. The system was retained at 45° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.0 μm stood formed.

Metal Salt Loading Step (Preparation of Metal Salt Loaded Resin Dispersion):

180 parts by mass of the water based dispersion of polyester resin F and 10 parts by mass of an aqueous 1% by mass calcium chloride solution were mixed by means of a homogenizer (ULTRATALUX T50, manufactured by IKA Works, Inc.) at a number of revolutions of 5,000 r/min for 10 minutes to carry out dispersion to prepare a metal salt loaded resin dispersion).

Shell Adhering Step:

To the above core agglomerated particles, the above metal salt loaded resin dispersion was dropwise added to further carry out treatment at 45° C. for 1 hour. As a result, it was ascertained that core-shell agglomerated particles having a volume average particle diameter of about 5.4 μm stood formed. At this stage, the particles were sampled in a small quantity, and then filtered with a filter of 1 μm in pore size, whereupon it was ascertained that the filtrate formed was colorless and transparent and the polyester resin F added supplementally had adhered in its total mass to the core particles.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.5 μm and an average circularity of 0.980. Thereafter, this was cooled to room temperature and then filtered, whereupon it was ascertained that the filtrate formed was colorless and transparent and the polyester resin F did not come to be liberated in the fusion step. Thereafter, the matter filtered out was sufficiently washed with ion-exchanged water, followed by drying by means of a vacuum drier to obtain toner particles 19. The circularity of the toner particles 19 was measured with the flow type particle image analyzer (FPIA-3000, manufactured by Sysmex Corporation) to find that it had an average circularity of 0.980.

Next, this toner particles 19 was mixed with 1.7% by mass of hydrophobic fine silica powder (primary average particle diameter: 0.01 μm) having a BET specific surface area of 200 $m^2/g$, to prepare a toner 19.

Example 20

Toner particles 20 and a toner 20 were obtained in the same way as in Example 19 except that the water based dispersion of polyester resin F in the metal salt loading step (preparation of metal salt loaded resin dispersion) of Example 19 was changed for a water based dispersion of styrene-acrylic copolymer D.

In this Example as well, any floating particles that might come from unreacted and liberated particles of the resin added supplementally was not seen to have come about in the shell adhering step and fusion step.

Comparative Example 1

Core Agglomeration Step:

| | |
|---|---|
| Water based dispersion of polyester resin A | 600 parts by mass |
| Colorant water based dispersion | 75 parts by mass |
| Release agent water based dispersion | 150 parts by mass |
| Aqueous 1% by mass magnesium sulfate solution | 150 parts by mass |
| Ion-exchanged water | 525 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 43° C. in a heating oil bath, using a stirring blade and controlling it appropriately at such a number of revolutions that the liquid mixture was stirred. The system was retained at 43° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.1 μm stood formed.

Shell Adhering Step:

To the above core agglomerated particles, 180 parts by mass of the water based dispersion of polyester resin F was dropwise added to further carry out treatment at 43° C. for 1 hour. As a result, it was ascertained that core-shell agglomerated particles having a volume average particle diameter of about 5.1 μm stood formed. At this stage, the particles were sampled in a small quantity, and then filtered with a filter of 1 μm in pore size, whereupon it was ascertained that the filtrate formed was milky and floating particles of the polyester resin F added supplementally remained.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.2 μm and an average circularity of 0.980. Thereafter, this was cooled to room temperature and then filtered, whereupon it was ascertained that the filtrate formed was milky and floating particles of the polyester resin F added supplementally remained in the fusion step. Thereafter, the matter filtered out was sufficiently washed with ion-exchanged water, followed by drying by means of a vacuum drier to obtain comparative toner particles 1. The circularity of the comparative toner particles 1 was measured with the flow type particle image analyzer (FPIA-3000, manufactured by Sysmex Corporation) to find that it had an average circularity of 0.980.

Next, this comparative toner particles 1 was mixed with 1.7% by mass of hydrophobic fine silica powder (primary average particle diameter: 0.01 μm) having a BET specific surface area of 200 $m^2/g$, to prepare a comparative toner 1.

Comparative Example 2

Comparative toner particles 2 and a comparative toner 2 were obtained in the same way as in Comparative Example 1 except that the water based dispersion of polyester resin F in the shell adhering step of Comparative Example 1 was changed for a water based dispersion of styrene-acrylic copolymer D.

In this Comparative Example, floating particles of the styrene-acrylic copolymer D were seen to have come about in the shell adhering step and fusion step.

Comparative Example 3

Core Agglomeration Step:

| | |
|---|---|
| Water based dispersion of polyester resin B | 600 parts by mass |
| Colorant water based dispersion | 75 parts by mass |
| Release agent water based dispersion | 150 parts by mass |
| Aqueous 1% by mass magnesium sulfate solution | 150 parts by mass |
| Ion-exchanged water | 525 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 35° C. in a heating oil bath, using a stirring blade and controlling it appropriately at such a number of revolutions that the liquid mixture was stirred. The system was retained at 35° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.2 μm stood formed.

Shell Adhering Step:

To the above core agglomerated particles, 180 parts by mass of the water based dispersion of polyester resin F was dropwise added to further carry out treatment at 35° C. for 1 hour. As a result, it was ascertained that core-shell agglomerated particles having a volume average particle diameter of about 5.3 μm stood formed. At this stage, the particles were sampled in a small quantity, and then filtered with a filter of 1 μm in pore size, whereupon it was ascertained that the filtrate formed was milky and floating particles of the polyester resin F added supplementally remained.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.2 μm and an average circularity of 0.980. Thereafter, this was cooled to room temperature and then filtered, whereupon it was ascertained that the filtrate formed was milky and floating particles of the polyester resin F added supplementally remained in the fusion step. Thereafter, the matter filtered out was sufficiently washed with ion-exchanged water, followed by drying by means of a vacuum drier to obtain comparative toner particles 3. The circularity of the comparative toner particles 3 was measured with the flow type particle image analyzer (FPIA-3000, manufactured by Sysmex Corporation) to find that it had an average circularity of 0.980.

Next, this comparative toner particles 3 was mixed with 1.7% by mass of hydrophobic fine silica powder (primary average particle diameter: 0.01 μm) having a BET specific surface area of 200 $m^2/g$, to prepare a comparative toner 3.

Comparative Example 4

Core Agglomeration Step:

| | |
|---|---|
| Water based dispersion of polyester resin C | 600 parts by mass |
| Colorant water based dispersion | 75 parts by mass |
| Release agent water based dispersion | 150 parts by mass |
| Aqueous 1% by mass magnesium sulfate solution | 150 parts by mass |
| Ion-exchanged water | 525 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 52° C. in a heating oil bath, using a stirring blade and controlling it appropriately at such a number of revolutions that the liquid mixture was stirred. The system was retained at 52° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.4 μm stood formed.

Shell Adhering Step:

To the above core agglomerated particles, 180 parts by mass of the water based dispersion of polyester resin F was dropwise added to further carry out treatment at 52° C. for 1 hour. As a result, it was ascertained that core-shell agglomerated particles having a volume average particle diameter of about 5.5 μm stood formed. At this stage, the particles were sampled in a small quantity, and then filtered with a filter of 1 μm in pore size, whereupon it was ascertained that the filtrate formed was milky and floating particles of the polyester resin F added supplementally remained.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.5 μm and an average circularity of 0.980. Thereafter, this was cooled to room temperature and then filtered, whereupon it was ascertained that the filtrate formed was milky and floating particles of the polyester resin F added supplementally remained in the fusion step. Thereafter, the matter filtered out was sufficiently washed with ion-exchanged water, followed by drying by means of a vacuum drier to obtain comparative toner particles 4. The circularity of the comparative toner particles 4 was measured with the flow type particle image analyzer (FPIA-3000, manufactured by Sysmex Corporation) to find that it had an average circularity of 0.980.

Next, this comparative toner particles 4 was mixed with 1.7% by mass of hydrophobic fine silica powder (primary average particle diameter: 0.01 μm) having a BET specific surface area of 200 $m^2/g$, to prepare a comparative toner 4.

Comparative Example 5

Core Agglomeration Step:

| | |
|---|---|
| Water based dispersion of styrene-acrylic copolymer A | 600 parts by mass |
| Colorant water based dispersion | 75 parts by mass |
| Release agent water based dispersion | 150 parts by mass |
| Aqueous 1% by mass calcium chloride solution | 300 parts by mass |
| Ion-exchanged water | 375 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 45° C. in a heating oil bath, using a stirring blade and controlling it appropriately at such a number of revolutions that the liquid mixture was stirred. The system was retained at 45° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.2 μm stood formed.

Shell Adhering Step:

To the above core agglomerated particles, 180 parts by mass of the water based dispersion of polyester resin F was dropwise added to further carry out treatment at 45° C. for 1 hour. As a result, it was ascertained that core-shell agglomerated particles having a volume average particle diameter of about 5.2 μm stood formed. At this stage, the particles were sampled in a small quantity, and then filtered with a filter of 1 μm in pore size, whereupon it was ascertained that the filtrate formed was milky and floating particles of the polyester resin F added supplementally remained.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.3 μm and an average circularity of 0.980. Thereafter, this was cooled to room temperature and then filtered, whereupon it was ascertained that the filtrate formed was milky and floating particles of the polyester resin F added supplementally remained in the fusion step. Thereafter, the matter filtered out was sufficiently washed with ion-exchanged water, followed by drying by means of a vacuum drier to obtain comparative toner particles 5. The circularity of the comparative toner particles 5 was measured with the flow type particle image analyzer (FPIA-3000, manufactured by Sysmex Corporation) to find that it had an average circularity of 0.980.

Next, this comparative toner particles 5 was mixed with 1.7% by mass of hydrophobic fine silica powder (primary average particle diameter: 0.01 μm) having a BET specific surface area of 200 $m^2/g$, to prepare a comparative toner 5.

Comparative Example 6

Comparative toner particles 6 and a comparative toner 6 were obtained in the same way as in Comparative Example 5 except that the water based dispersion of polyester resin F in the shell adhering step of Comparative Example 5 was changed for a water based dispersion of styrene-acrylic copolymer D.

In this Comparative Example, floating particles of the styrene-acrylic copolymer D were seen to have come about in the shell adhering step and fusion step.

Comparative Example 7

Core Agglomeration Step:

| | |
|---|---|
| Water based dispersion of polyester resin A | 600 parts by mass |
| Colorant water based dispersion | 75 parts by mass |
| Release agent water based dispersion | 150 parts by mass |
| Aqueous 1% by mass magnesium sulfate solution | 150 parts by mass |
| Ion-exchanged water | 525 parts by mass |

The above components were introduced into a round flask made of stainless steel, and then mixed by means of a homogenizer (ULTRATALUX T50, manufactured by IKA Works, Inc.) at a number of revolutions of 5,000 r/min for 10 minutes to carry out dispersion. Thereafter, this was heated to 43° C. in a heating oil bath, using a stirring blade and controlling it appropriately at such a number of revolutions that the liquid mixture was stirred. The system was retained at 43° C. for 1 hour, and thereafter the volume average particle diameter of the agglomerated particles thus formed was measured with a flow type particle image analyzer (FPIA-3000, manufactured by Sysmex Corporation) according to an operation manual attached to the instrument. As a result, it was ascertained that core agglomerated particles having a volume average particle diameter of about 5.1 μm stood formed.

Resin Dispersion Preparation Step:

180 parts by mass of the water based dispersion of polyester resin F and 10 parts by mass of ion-exchanged water were mixed by means of a homogenizer (ULTRATALUX T50, manufactured by IKA Works, Inc.) at a number of revolutions of 5,000 r/min for 10 minutes to carry out dispersion to prepare a resin dispersion.

Shell Adhering Step:

To the above core agglomerated particles, the above resin dispersion was dropwise added to further carry out treatment at 43° C. for 1 hour. As a result, it was ascertained that core-shell agglomerated particles having a volume average particle diameter of about 5.2 μm stood formed. At this stage, the particles were sampled in a small quantity, and then filtered with a filter of 1 μm in pore size, whereupon it was ascertained that the filtrate formed was milky and floating particles of the polyester resin F added supplementally remained.

Fusion Step:

Thereafter, to the above core-shell agglomerated particles, an aqueous solution prepared by dissolving 15 parts by mass of trisodium citrate in 285 parts by mass of ion-exchanged water was added, followed by heating to 90° C. with stirring continued, and this was retained for 3 hours. The volume average particle diameter and average circularity of the particles obtained were measured with the flow type particle image analyzer (FPIA-3000, manufactured by Sysmex Corporation) according to an operation manual attached to the instrument. As a result, it was ascertained that particles sufficiently fused and joined together stood formed which had a volume average particle diameter of about 5.2 μm and an average circularity of 0.980. Thereafter, this was cooled to room temperature and then filtered, whereupon it was ascertained that the filtrate formed was milky and floating particles of the polyester resin F added supplementally remained in the fusion step. Thereafter, the matter filtered out was sufficiently washed with ion-exchanged water, followed by drying by means of a vacuum drier to obtain comparative toner particles 7. The circularity of the comparative toner particles 7 was measured with the flow type particle image analyzer (FPIA-3000, manufactured by Sysmex Corporation) to find that it had an average circularity of 0.980.

Next, this comparative toner particles 7 was mixed with 1.7% by mass of hydrophobic fine silica powder (primary average particle diameter: 0.01 μm) having a BET specific surface area of 200 $m^2/g$, to prepare a comparative toner 7.

Comparative Example 8

Comparative toner particles 8 and a comparative toner 8 were obtained in the same way as in Comparative Example 7 except that ion-exchanged water in the resin dispersion preparation step was changed for an aqueous 1 mol/liter NaOH solution.

In this Comparative Example as well, floating particles of the polyester resin F added supplementally were seen to have come about in the shell adhering step and fusion step.

Toner Evaluation

The above toners 1 to 20 and comparative toners 1 to 8 were used to make evaluation on the following. The results are shown in Table 1.

Evaluation of Blocking Resistance:

A: Any aggregate is not seen when left to stand for a day, under conditions of 5° C. plus glass transition temperature (Tg1) of the resin making up the core particles.

B: Aggregates are seen when left to stand for a day, under conditions of 5° C. plus glass transition temperature (Tg1) of the resin making up the core particles.

Evaluation of Fixing Performance:

Each toner and a ferrite carrier (average particle diameter: 42 μm) surface-coated with silicone resin were so blended as to be 6% by mass in toner concentration, to prepare a two-component developer. Using this two-component developer, unfixed toner images (toner laid-on level: 0.6 $mg/cm^2$) were formed on image-receiving paper (64 $g/m^2$) by using a commercially available full-color digital copying machine (CLC1100, manufactured by CANON INC.). A fixing unit detached from a commercially available color printer (LPB-5500, manufactured by CANON INC.) was so converted that its fixing temperature can be controlled, and fixing of the unfixed toner images was tested in an environment of normal temperature and normal humidity (25° C./60% RH) and setting its process speed at 100 mm/second. The fixing was performed 9 times changing the preset temperature of the fixing unit at intervals of 10° C. in the range of from 120° C. to 200° C., and how was anti-offset for fixed images was visually observed to make evaluation as fixing performance.

About the comparative toners 1 to 8, their core particles were not sufficiently covered with shell particles to make it unable to secure any necessary blocking resistance, and hence the evaluation of fixing performance was deemed to be impossible.

Fixing Temperature Range where No Offset Occurs:

A: 7 degrees or more for fixed images where no offset is seen to have occurred.

B: 5 to 6 degrees for fixed images where no offset is seen to have occurred.

C: 4 degrees or less for fixed images where no offset is seen to have occurred.

TABLE 1

| | Core make-up | | Shell make-up | | | Physical properties of toner particles | | | | | |
|---|---|---|---|---|---|---|---|---|---|---|---|
| | Resin | Tg1 (° C.) | Resin | Tg1 (° C.) | Metal salt | Wt. av. particle diam. D4 (μm) | D4/D1 | Average circularity | Floating particles | Blocking resistance | Anti-offset |
| Example: | | | | | | | | | | | |
| 1 | Polyester A | 45 | Polyester F | 66 | $CaCl_2$ | 5.36 | 1.16 | 0.980 | no | A | A |
| 2 | Polyester A | 45 | Polyester F | 66 | $MgSO_4$ | 5.40 | 1.18 | 0.978 | no | A | A |
| 3 | Polyester A | 45 | Polyester F | 66 | $ZnCl_2$ | 5.30 | 1.18 | 0.979 | no | A | A |
| 4 | Polyester A | 45 | Polyester F | 66 | NaCl | 5.66 | 1.24 | 0.980 | no | A | A |
| 5 | Polyester A | 45 | Polyester F | 66 | KCl | 5.60 | 1.24 | 0.980 | no | A | A |
| 6 | Polyester A | 45 | Polyester F | 66 | $Al_2(SO_4)_3$ | 5.70 | 1.25 | 0.978 | no | A | A |
| 7 | Polyester A | 45 | Polyester F | 66 | $Fe_2(SO_4)_3$ | 5.68 | 1.25 | 0.980 | no | A | A |
| 8 | Polyester A | 45 | Polyester E | 66 | $CaCl_2$ | 5.42 | 1.16 | 0.980 | no | A | A |
| 9 | Polyester A | 45 | Polyester G | 72 | $CaCl_2$ | 5.40 | 1.16 | 0.977 | no | A | B |
| 10 | Polyester A | 45 | Styrene D | 65 | $CaCl_2$ | 5.50 | 1.17 | 0.979 | no | A | B |
| 11 | Polyester B | 37 | Polyester F | 66 | $CaCl_2$ | 5.62 | 1.16 | 0.980 | no | A | B |
| 12 | Polyester C | 56 | Polyester F | 66 | $CaCl_2$ | 5.42 | 1.16 | 0.980 | no | A | B |
| 13 | Polyester D | 46 | Polyester F | 66 | $CaCl_2$ | 5.33 | 1.17 | 0.980 | no | A | A |
| 14 | Polyester D | 46 | Polyester E | 66 | $CaCl_2$ | 5.45 | 1.17 | 0.977 | no | A | B |
| 15 | Polyester D | 46 | Styrene D | 65 | $CaCl_2$ | 5.50 | 1.19 | 0.977 | no | A | B |
| 16 | Styrene A | 48 | Polyester F | 66 | $CaCl_2$ | 5.45 | 1.16 | 0.980 | no | A | B |
| 17 | Styrene A | 48 | Styrene C | 65 | $CaCl_2$ | 5.50 | 1.16 | 0.978 | no | A | B |
| 18 | Styrene A | 48 | Styrene D | 65 | $CaCl_2$ | 5.58 | 1.16 | 0.978 | no | A | B |
| 19 | Styrene B | 48 | Polyester F | 66 | $CaCl_2$ | 5.55 | 1.16 | 0.980 | no | A | B |
| 20 | Styrene B | 48 | Styrene D | 65 | $CaCl_2$ | 5.58 | 1.16 | 0.977 | no | A | B |
| Comparative Example: | | | | | | | | | | | |
| 1 | Polyester A | 45 | Polyester F | 66 | — | 5.51 | 1.16 | 0.980 | occur | B | Ev. Ip. |
| 2 | Polyester A | 45 | Styrene D | 65 | — | 5.49 | 1.16 | 0.980 | occur | B | Ev. Ip. |
| 3 | Polyester B | 37 | Polyester F | 66 | — | 5.20 | 1.16 | 0.980 | occur | B | Ev. Ip. |
| 4 | Polyester C | 56 | Polyester F | 66 | — | 5.25 | 1.18 | 0.980 | occur | B | Ev. Ip. |
| 5 | Styrene A | 48 | Polyester F | 66 | — | 5.12 | 1.18 | 0.980 | occur | B | Ev. Ip. |
| 6 | Styrene A | 48 | Styrene D | 65 | — | 5.52 | 1.18 | 0.980 | occur | B | Ev. Ip. |
| 7 | Polyester A | 45 | Polyester F | 66 | ($H_2O$) | 5.28 | 1.16 | 0.980 | occur | B | Ev. Ip. |
| 8 | Polyester A | 45 | Polyester F | 66 | (NaOH) | 5.20 | 1.19 | 0.978 | occur | B | Ev. Ip. |

Ev. Ip.: Evaluation is impossible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-128493, filed May 28, 2009, which is hereby incorporated by reference herein in its entirety.

The invention claimed is:

1. A process for producing a core-shell toner having core particles which contain at least a resin (1), a colorant and a release agent and shell layers which contain at least a resin (2) and with which the core particles are covered; the process comprising:

providing a resin (1) dispersion in which at least the resin (1) stands dispersed in a dispersion medium;

providing a colorant dispersion in which at least the colorant stands dispersed in a dispersion medium;

providing a release agent dispersion in which at least the release agent stands dispersed in a dispersion medium;

mixing at least the resin (1) dispersion, the colorant dispersion and the release agent dispersion, to obtain a mixed dispersion;

adding an agglomerating agent to the mixed dispersion to make the resin (1), the colorant and the release agent agglomerate to form core agglomerated particles;

providing a resin (2) dispersion in which at least the resin (2) stands dispersed in a dispersion medium;

loading a metal salt into the resin (2) dispersion in order to electrostatically neutralize the resin (2) dispersion;

adding the metal salt loaded resin dispersion to a dispersion in which the core agglomerated particles stand dispersed, to make the resin (2) adhere to the surfaces of the core agglomerated particles to form core-shell agglomerated particles; and heating the core-shell agglomerated particles to a temperature not lower than the glass transition temperature of the resin (1) and resin (2) to effect fusion thereof.

2. The process for producing a core-shell toner according to claim 1, wherein the resin (1) has at least a carboxyl group as an acid group.

3. The process for producing a core-shell toner according to claim 1, wherein the resin (2) has at least a sulfonic acid group as an acid group.

4. The process for producing a core-shell toner according to claim 1, wherein the metal salt is a divalent or more polyvalent metal salt.

5. The process for producing a core-shell toner according to claim 1, wherein the metal salt is a divalent metal salt.

6. The process for producing a core-shell toner according to claim 1, wherein the resin (1) is a polyester resin.

7. The process for producing a core-shell toner according to claim 1, wherein the resin (2) is a polyester resin.

8. The process for producing a core-shell toner according to claim 1, wherein glass transition temperature Tg1 of the resin (1) and glass transition temperature Tg2 of the resin (2) satisfy the following expression:

$$30^\circ\ C. < Tg1 < 60^\circ\ C. < Tg2 < 80^\circ\ C.$$

9. A toner obtained by the process for producing a core-shell toner according to claim 1.

* * * * *